US009332619B2

(12) United States Patent
Olsen et al.

(10) Patent No.: US 9,332,619 B2
(45) Date of Patent: May 3, 2016

(54) SOLID-STATE LUMINAIRE WITH MODULAR LIGHT SOURCES AND ELECTRONICALLY ADJUSTABLE LIGHT BEAM DISTRIBUTION

(71) Applicants: Joseph Allen Olsen, Gloucester, MA (US); Michael Quilici, Essex, MA (US); Seung Cheol Ryu, Marblehead, MA (US)

(72) Inventors: Joseph Allen Olsen, Gloucester, MA (US); Michael Quilici, Essex, MA (US); Seung Cheol Ryu, Marblehead, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 14/725,119

(22) Filed: May 29, 2015

(65) Prior Publication Data

US 2015/0264779 A1 Sep. 17, 2015

Related U.S. Application Data

(63) Continuation-in-part of application No. 14/032,821, filed on Sep. 20, 2013, and a continuation-in-part of application No. 14/032,856, filed on Sep. 20, 2013.

(51) Int. Cl.

| | |
|---|---|
| ***H05B 37/02*** | (2006.01) |
| ***F21K 99/00*** | (2016.01) |
| ***H05B 33/08*** | (2006.01) |
| ***F21S 8/02*** | (2006.01) |
| ***F21S 8/06*** | (2006.01) |

(Continued)

(52) U.S. Cl.

CPC ..... *H05B 37/0263* (2013.01); *F21K 9/56* (2013.01); *F21S 8/026* (2013.01); *F21S 8/046* (2013.01); *F21S 8/06* (2013.01); *F21S 10/023* (2013.01); *F21V 14/06* (2013.01); *F21V 23/045* (2013.01); *F21V 23/0435* (2013.01); *H05B 33/0842* (2013.01); *H05B 37/0272* (2013.01); *F21L 4/00* (2013.01); *F21S 6/00* (2013.01); *F21V 23/0478* (2013.01); *F21V 23/0485* (2013.01); *F21Y 2101/02* (2013.01); *F21Y 2101/025* (2013.01); *F21Y 2111/002* (2013.01)

(58) Field of Classification Search

USPC ..... 315/149, 150, 291, 294, 307, 308; 362/147, 227, 240, 277, 317, 319, 362

See application file for complete search history.

(56) References Cited

U.S. PATENT DOCUMENTS 8,525,421 B2 * 9/2013 Kim ..... F21S 2/005 315/149
8,820,963 B2 * 9/2014 Olsen ..... F21V 5/007 315/151

(Continued)

*Primary Examiner* — Thai Pham
(74) *Attorney, Agent, or Firm* — Andrew Martin

(57) ABSTRACT

A luminaire having a plurality of power sockets arranged over its housing is disclosed. In some embodiments, the luminaire includes a driver operatively coupled with all (or some subset) of the power sockets and configured to control the light output of a modular solid-state light source operatively interfaced therewith. In some such embodiments, the luminaire also includes a power-line communication (PLC) module configured to output a PLC signal utilized by the driver in controlling the modular light source's output. In some other embodiments, the modular light source includes the driver, which may utilize a PLC signal, a command signal received from a remote source, or both, in controlling light output. In some cases, the modular solid-state light sources may allow the luminaire to produce a target light beam distribution utilizing a minimal or otherwise reduced quantity of such light sources, reducing cost and difficulty of installation and commissioning.

20 Claims, 10 Drawing Sheets

(51) Int. Cl.

| | |
|---|---|
| ***F21V 14/06*** | (2006.01) |
| ***F21V 23/04*** | (2006.01) |
| ***F21S 8/04*** | (2006.01) |
| ***F21S 10/02*** | (2006.01) |
| *F21Y 101/02* | (2006.01) |
| *F21L 4/00* | (2006.01) |
| *F21S 6/00* | (2006.01) |
| *F21Y 111/00* | (2016.01) |

(56) References Cited

U.S. PATENT DOCUMENTS

2002/0181231 A1* 12/2002 Luk ..... F21V 5/008
362/240
2011/0235350 A1* 9/2011 Kessler ..... B60Q 3/0253
362/471

* cited by examiner

SOLID-STATE LUMINAIRE WITH MODULAR LIGHT SOURCES AND ELECTRONICALLY ADJUSTABLE LIGHT BEAM DISTRIBUTION

CROSS-REFERENCE TO RELATED APPLICATIONS

This patent application is a Continuation-in-Part of U.S. Non-Provisional patent application Ser. No. 14/032,821, titled "Solid-State Luminaire with Electronically Adjustable Light Beam Distribution," filed on Sep. 20, 2013, and U.S. Non-Provisional patent application Ser. No. 14/032,856, titled "Solid-State Luminaire with Pixelated Control of Light Beam Distribution," filed on Sep. 20, 2013. This patent application is also related to: U.S. Non-Provisional patent application Ser. No. 14/221,589, titled "Techniques and Graphical User Interface for Controlling Solid-State Luminaire with Electronically Adjustable Light Beam Distribution," filed on Mar. 21, 2014; U.S. Non-Provisional patent application Ser. No. 14/221,638, titled "Techniques and Photographical User Interface for Controlling Solid-State Luminaire with Electronically Adjustable Light Beam Distribution," filed on Mar. 21, 2014; U.S. Non-Provisional patent application Ser. No. 14/531,427, titled "Solid-State Lamps with Electronically Adjustable Light Beam Distribution," filed on Nov. 3, 2014; and U.S. Non-Provisional patent application Ser. No. 14/531,375, titled "Lighting Techniques Utilizing Solid-State Lamps with Electronically Adjustable Light Beam Distribution," filed on Nov. 3, 2014; and U.S. Non-Provisional patent application Ser. No. 14/531,488, titled "Solid-State Luminaire with Electronically Adjustable Light Beam Distribution," filed on Nov. 3, 2014. Each of these patent applications is herein incorporated by reference in its entirety.

FIELD OF THE DISCLOSURE

The present disclosure relates to solid-state lighting (SSL) fixtures and more particularly to light-emitting diode (LED)-based luminaires.

BACKGROUND

Traditional adjustable lighting fixtures, such as those utilized in theatrical lighting, employ mechanically adjustable lenses, track heads, gimbal mounts, and other mechanical parts to adjust the angle and direction of the light output thereof. To adjust their light distribution, these existing lighting designs rely upon mechanical movements provided by actuators, motors, or other movable components manipulated by a lighting technician or other user. However, the cost of such designs is normally high given the complexity of the mechanical equipment required to provide the desired degree of adjustability.

Figure 1A:
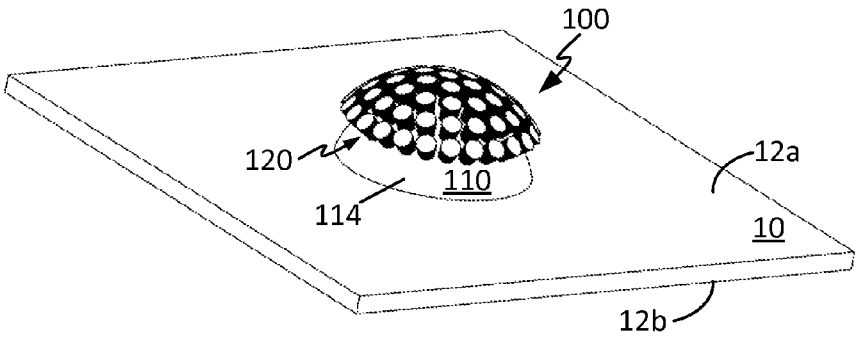
FIGS. 1A-1B illustrate several perspective views of a luminaire configured in accordance with an embodiment of the present disclosure.

These and other features of the present embodiments will be understood better by reading the following detailed description, taken together with the figures herein described. The accompanying drawings are not intended to be drawn to scale. In the drawings, each identical or nearly identical component that is illustrated in various figures may be represented by a like numeral. For purposes of clarity, not every component may be labeled in every drawing.

DETAILED DESCRIPTION

A luminaire having a plurality of power sockets arranged over its housing is disclosed. In some embodiments, the luminaire includes a driver operatively coupled with all (or some sub-set) of the power sockets and configured to control the light output of a modular solid-state light source operatively interfaced therewith. In some instances in which the power sockets are wired in series, the driver may be, for example, a constant current driver. In some embodiments, the luminaire includes a power-line communication (PLC) module configured to output a PLC signal utilized by the driver in controlling the modular light source's output. In accordance with some other embodiments, the modular light source includes the driver, which may utilize a PLC signal, a command signal received from a remote source, or both, in controlling light output. In some embodiments, the power sockets are populated on a printed circuit board (PCB), which may be foldable in some cases. The modular solid-state light sources can be electronically controlled to provide the host luminaire with an electronically adjustable light beam distribution capable of highly adjustable light emissions, in accordance with some embodiments. In some cases, the modular light sources may allow a host luminaire to produce a target light beam distribution for a given space or lighting application utilizing a minimal or otherwise reduced quantity of such light sources, reducing the cost and difficulty of installation and commissioning. Numerous configurations and variations will be apparent in light of this disclosure.

General Overview

Existing solid-state lighting fixtures normally have fixed light beam distributions that are determined by their optical construction. As such, these fixtures do not allow a user to adjust the light distribution without physically modifying, moving, or replacing the fixture. Given these limitations of existing designs, there is typically a need for use of a group of specific lighting fixtures with specific candlepower distributions in order to fill a given space. For instance, in the example context of retail lighting, existing lighting designs utilize a series of individual solid-state lamps that must be physically aimed and focused individually in an iterative manner during installation and commissioning in order to illuminate displayed products. Also, these lighting designs are generally high in cost given the complexity of the mechanical equipment required to provide the desired degree of adjustability. Furthermore, there is a safety concern associated with the need to manually adjust, repair, and replace components of these types of systems, particularly in areas which are normally out-of-reach without the use of a ladder, scaffolding, or aerial work platform, for example.

Thus, and in accordance with some embodiments of the present disclosure, a luminaire having a plurality of power sockets arranged over its housing is disclosed. In some embodiments, the luminaire includes a driver operatively coupled with all (or some sub-set) of the power sockets and configured to control the light output of a modular solid-state light source operatively interfaced therewith. In some instances in which the power sockets are wired in series, the driver may be, for example, a constant current driver. In some embodiments, the luminaire includes a power-line communication (PLC) module configured to output a PLC signal utilized by the driver in controlling the modular light source's output. In accordance with some other embodiments, the modular light source includes the driver, which may utilize a PLC signal, a command signal received from a remote source, or both, in controlling light output. In some embodiments, the power sockets are populated on a printed circuit board (PCB), which may be foldable in some cases. The modular light sources can be electronically controlled to provide the host luminaire with an electronically adjustable light beam distribution capable of highly adjustable light emissions, in accordance with some embodiments. In some cases, the modular light sources may allow a host luminaire to produce a target light beam distribution for a given space or lighting application utilizing a minimal or otherwise reduced quantity of such light sources, reducing the cost and difficulty of installation and commissioning.

In accordance with some embodiments, a modular solid-state light source configured as described herein may be inserted into or otherwise operatively interfaced with a given power socket of the disclosed luminaire. The arrangement of modular solid-state light sources operatively interfaced with power sockets of the luminaire can be customized, as desired for a given target application or end-use, in accordance with some embodiments. In some cases, only those modular solid-state light sources needed to produce a target light beam distribution for a given space or target lighting application may be installed with the luminaire, thereby minimizing or otherwise reducing the total quantity of modular solid-state light sources for that luminaire. In this manner, the disclosed luminaire can be used, for example, to produce custom light beam patterns that allow for highly flexible light distributions while realizing improvements in lighting efficiency, as well as providing for greater ease and reduced cost of installation and commissioning as compared to existing solid-state luminaires. In accordance with some embodiments, the modular solid-state light sources of the disclosed luminaire may permit it to be transitioned between an initial setup as a lighting design configuration tool and a final setup for installation. Thus, as will be appreciated in light of this disclosure, flexibility in light beam distribution may be retained without incurring the full cost of a full array of solid-state light sources, which otherwise might be cost-prohibitive for a given lighting application. In some cases, empty power sockets of the disclosed luminaire can be blanked, for example, using a filler plug, a knockout piece, or other suitable element (e.g., for safety, aesthetics, etc.).

In accordance with some embodiments, the one or more solid-state emitters of each modular solid-state light source may be addressable individually, in one or more groupings, or both. As such, the modular solid-state light sources can be electronically controlled individually, in conjunction with one another, or both, providing the host luminaire with an electronically adjustable light beam distribution capable of highly adjustable light emissions. In some embodiments, the luminaire may be configured, for example, to be mounted on, suspended from, or extended from a surface such as a drop ceiling tile or wall, among others. In some other embodiments, the luminaire may be configured, for example, as a free-standing lighting device, such as a desk lamp or torchière lamp, among others. As will be appreciated in light of this disclosure, such a design may allow for great flexibility with respect to lighting direction and angular distribution in a relatively compact lighting fixture.

In accordance with some embodiments, a modular solid-state light source configured as described herein may include or otherwise be communicatively coupled with one or more controllers and driver circuitry that can be used to electronically control the output of its solid-state emitters individually, in conjunction with one another, or both, (e.g., as an array or grouping; as a partial array or grouping), thereby electronically controlling the output of the host luminaire as a whole. In some cases, a controller configured as described herein may provide for electronic adjustment, for example, of the beam direction, beam angle, beam distribution, beam diameter, or a combination of any one or more thereof, for each modular solid-state light source (or some sub-set of the available modular solid-state light sources). In some such cases, this may allow for customizing the host luminaire's beam spot size, position, angular distribution, or a combination of any one or more thereof. In some cases, the disclosed driver may provide for electronic adjustment, for example, of the brightness of light, color of light, or both, thereby allowing for dimming, color mixing, color tuning, or a combination of any one or more thereof, as desired for a given target application or end-use. In accordance with some embodiments, the solid-state emitters of a luminaire configured as described herein may be controlled to manipulate beam angle and distribution, for example, without the need for mechanically moving parts and physical access to the luminaire. In a more general sense, and in accordance with an embodiment, the properties of the light output of a luminaire configured as described herein may be adjusted electronically without need for mechanical movements, contrary to existing lighting systems. Also, as discussed herein, control of the emissions of the disclosed luminaire may be provided, in accordance with some embodiments, using any of a wide range of control interfaces, both wired and wireless, such as a switch array, a touch-sensitive surface or device, or a computer vision system (e.g., that is gesture-sensitive, activity-sensitive, or motion-sensitive, for example), to name a few. In some instances, a given control interface may be configured to allow a user to quickly and easily reconfigure the light distribution in a given space, as desired.

In accordance with some embodiments, the disclosed luminaire can be configured as a recessed light, a pendant light, a sconce, or the like, which may be mounted on or suspended from, for example, a ceiling, wall, floor, step, or other suitable surface, as will be apparent in light of this disclosure. In some other embodiments, the disclosed luminaire can be configured as a free-standing lighting device, such as a desk lamp or torchière lamp. In some other embodiments, a luminaire configured as described herein may be mounted, for example, on a drop ceiling tile (e.g., 1 ft.×1 ft., 2 ft.×2 ft., 2 ft.×4 ft., 4 ft.×4 ft., or larger) for installation in a drop ceiling grid. In some other embodiments, the disclosed luminaire may be configured, for instance, to substitute for a drop ceiling tile in a drop ceiling grid. In some still other embodiments, a luminaire configured as described herein may be embedded, in part or in whole, into a given mounting surface (e.g., plastered into a ceiling, wall, or other structure). In some such cases, a seamless exterior appearance between the luminaire and the mounting surface may be provided, for instance, such that only an aperture through which the light passes may be visible. Some embodiments may be configured, for example, to provide an electronically tunable light beam distribution without need for mechanical movement and in a generally compact form factor. Numerous suitable configurations will be apparent in light of this disclosure.

As will be appreciated in light of this disclosure, a luminaire configured as described herein may provide for flexible and easily adaptable lighting, capable of accommodating any of a wide range of lighting applications and contexts, in accordance with some embodiments. For example, some embodiments may provide for downlighting adaptable to small and large area tasks (e.g., high intensity with adjustable distribution and directional beams). Some embodiments may provide for accent lighting or area lighting of any of a wide variety of distributions (e.g., narrow, wide, asymmetrical, tilted, Gaussian, batwing, or other specifically shaped light beam distribution). By turning on/off, dimming, or otherwise adjusting the intensity of various combinations of solid-state emitters of the luminaire, the light beam output may be adjusted, for instance, to produce uniform illumination on a given surface, to fill a given space with light, or to generate any desired area lighting distributions. Some embodiments can be used, for example, in a wide range of lighting applications and contexts, including retail and personal care, among others. Some embodiments may provide for simplified light output aiming, commissioning, installation, or a combination of any one or more thereof, as compared to existing designs and approaches. Numerous suitable uses and applications will be apparent in light of this disclosure.

As will be further appreciated in light of this disclosure, a luminaire configured as described herein may be considered, in a general sense, a robust, intelligent, multi-purpose lighting platform capable of producing a highly adjustable light output without requiring mechanical movement of luminaire componentry. Some embodiments may provide for a greater level of light beam adjustability, for example, as compared to traditional lighting designs utilizing larger moving mechanical parts. Some embodiments may realize a reduction in cost, for example, as a result of the use of longer-lifespan solid-state devices and reduced installation, operation, commissioning, and other labor costs. Furthermore, the scalability and orientation of a luminaire configured as described herein may be varied, in accordance with some embodiments, to adapt to a specific lighting context or application (e.g., downward-facing, such as a drop ceiling lighting fixture, pendant lighting fixture, a desk light, etc.; upward-facing, such as indirect lighting aimed at a ceiling). In some instances, a luminaire provided using the disclosed techniques can be configured, for example, as a partially or completely assembled luminaire unit or a kit or other collection of discrete components (e.g., housing, solid-state light source modules, etc.) that may be operatively coupled, as desired.

System Architecture and Operation

Figure 1B:
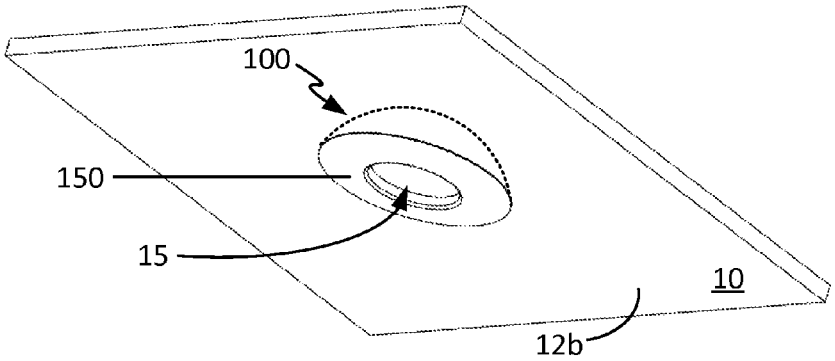
Figure 2A:
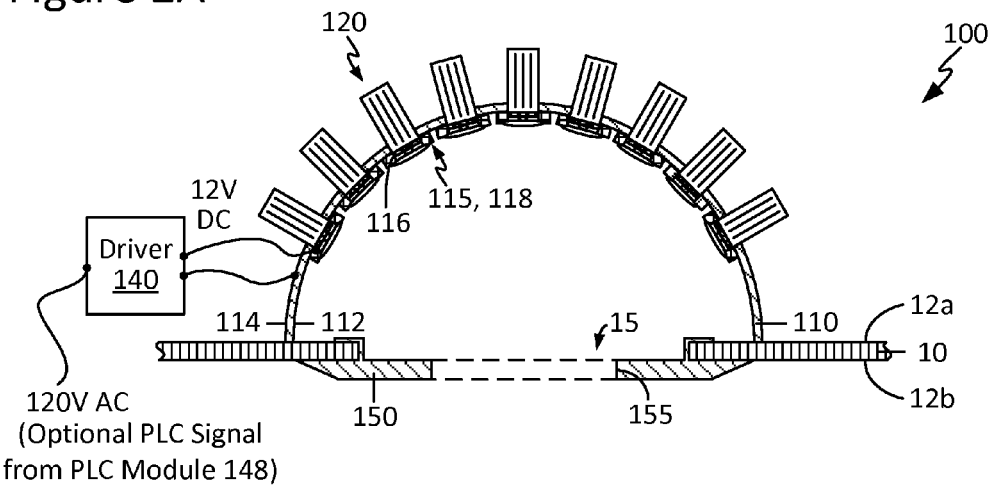
FIG. 2A illustrates a cross-sectional view of a luminaire configured in accordance with an embodiment of the present disclosure.
Figure 2B:
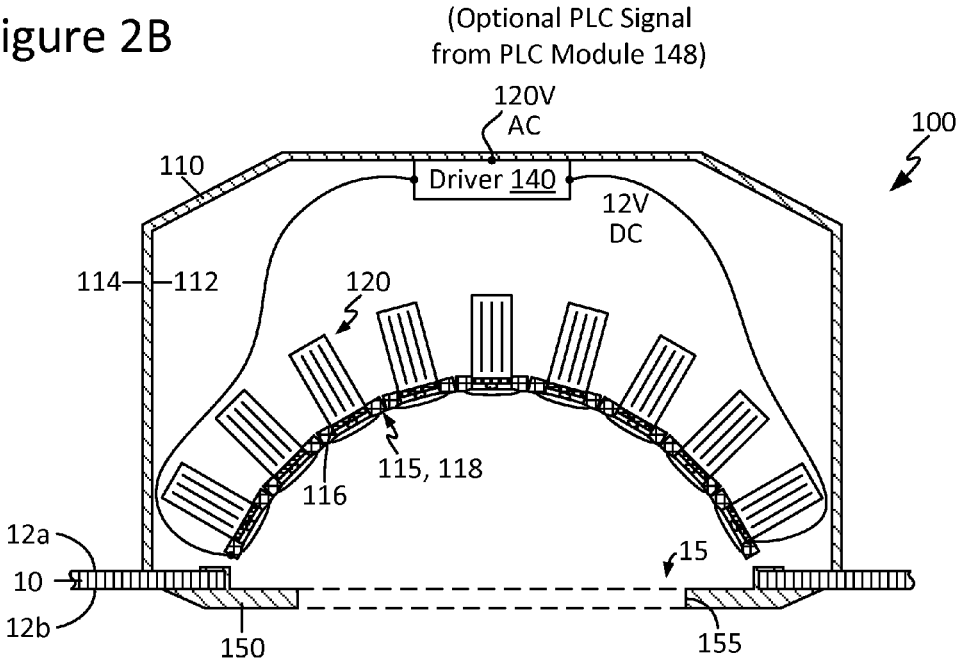
FIG. 2B illustrates a cross-sectional view of a luminaire configured in accordance with another embodiment of the present disclosure.
Figure 3A:
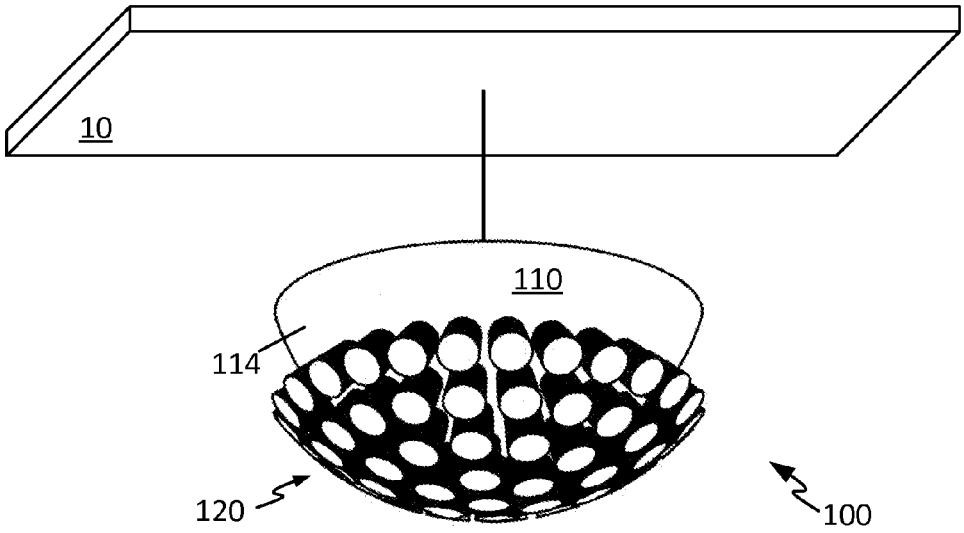
FIG. 3A illustrates a perspective view of a luminaire configured in accordance with another embodiment of the present disclosure.
Figure 3B:
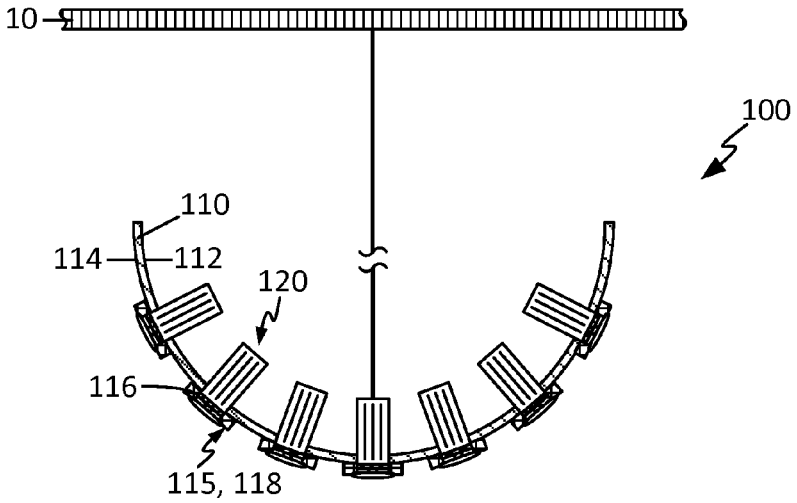
FIG. 3B illustrates a cross-sectional view of a luminaire configured in accordance with another embodiment of the present disclosure.

FIGS. 1A-1B illustrate several perspective views of a luminaire 100 configured in accordance with an embodiment of the present disclosure. FIG. 2A illustrates a cross-sectional view of a luminaire 100 configured in accordance with an embodiment of the present disclosure. FIG. 2B illustrates a cross-sectional view of a luminaire 100 configured in accordance with another embodiment of the present disclosure. FIGS. 3A-3B illustrate perspective and cross-sectional views, respectively, of a luminaire 100 configured in accordance with another embodiment of the present disclosure.

As can be seen from the figures, luminaire 100 includes a housing 110. The shape of housing 110 can be customized, as desired for a given target application or end-use, and in some cases may be selected, in part or in whole, based on a given desired amount of overlap for the light beams emitted by luminaire 100. In some embodiments, such as that illustrated in FIG. 2A, luminaire 100 may include a housing 110 of generally hemispherical shape (e.g., hemispherical, sub-hemispherical, hyper-hemispherical, or oblate hemispherical, among others). In some other embodiments, such as that illustrated in FIG. 2B, luminaire 100 may include a can-style recessed lighting housing 110, such as, for instance, an insulation contact (IC) housing, a non-IC housing, or an airtight (AT) housing, among others. In some still other embodiments, luminaire 100 may include a housing 110 of generally polyhedral shape (e.g., Platonic solid-type), providing one or more planar interior surfaces 112, exterior surfaces 114, or both, of triangular, rectangular, or trapezoidal geometry, among others. In some instances, housing 110 may have a non-planar interior surface 112, non-planar exterior surface 114, or both, of generally curvilinear or otherwise smooth contour. In some cases, housing 110 may have a non-planar interior surface 112, a non-planar exterior surface 114, or both, of faceted, angled, articulated, or otherwise non-smooth contour. Housing 110 may be concave or convex in shape, in part or in whole, in accordance with some embodiments. Numerous suitable configurations for housing 110 will be apparent in light of this disclosure.

The dimensions of housing 110 can be customized, as desired for a given target application or end-use. In some cases, housing 110 may have a width or diameter in the range of about 1-24 inches (e.g., about 1-6 inches, about 6-12 inches, about 12-18 inches, about 18-24 inches, or any other sub-range within the range of about 1-24 inches). In some other cases, housing 110 may have a width or diameter of about 24 inches or greater (e.g., about 30 inches or greater; about 36 inches or greater; about 42 inches or greater; about 48 inches or greater). In some instances, housing 110 may have a height or depth in the range of about 1-24 inches (e.g., about 1-6 inches, about 6-12 inches, about 12-18 inches, about 18-24 inches, or any other sub-range within the range of about 1-24 inches). Other suitable sizes for housing 110 will depend on a given application and will be apparent in light of this disclosure.

In accordance with some embodiments, the geometry and dimensions of housing 110 may be varied, for example, to be commensurate with the particular mounting surface 10 over which it is to be mounted or other space that it is to occupy (e.g., mounted on a drop ceiling tile; suspended from a ceiling or other overhead structure; extending from a wall, floor, or step; embedded, in part or in whole, in a ceiling, wall, or other surface; configured as a free-standing or otherwise portable lighting device). In some embodiments, housing 110 may be configured, for example, as a troffer that be mounted on or substituted for a drop ceiling tile (e.g., 1 ft.×1 ft., 2 ft.×2 ft., 2 ft.×4 ft., 4 ft.×4 ft., or larger) for installation in a drop ceiling grid. In some instances, the geometry and dimensions of housing 110 may be selected, in part or in whole, based on the dimensions of a given aperture 15 (discussed below) through which the emissions of luminaire 100 are to pass.

In accordance with some embodiments, housing 110 may be constructed to house or otherwise support the one or more solid-state light sources 120 (discussed below) of luminaire 100, as well as to conduct thermal energy away from those solid-state light source(s) 120 to the ambient environment. To such ends, housing 110 may be constructed, in part or in whole, from any suitable materials, such as, for example, aluminum (Al), copper (Cu), brass, steel, a sheet metal, a cast metal, a composite or polymer (e.g., ceramics, plastics, etc.) doped with thermally conductive material, or a combination thereof, among others. Other suitable materials from which housing 110 may be constructed will depend on a given application and will be apparent in light of this disclosure.

As can be seen further from the figures, luminaire 100 includes one or more power sockets 116 arranged over its housing 110. A given power socket 116 may be configured, in accordance with some embodiments, to operatively interface with a given solid-state light source 120 (discussed below), allowing that solid-state light source 120 to draw power therefrom. To that end, a given power socket 116 of luminaire 100 can be any standard, custom, or proprietary power connection or receptacle, as desired for a given target application or end-use. For instance, in some embodiments, a given power socket 116 may be configured as a DC connector or power socket, such as a cigarette lighter receptacle or other automotive auxiliary power outlet as typically can be found in an automobile. In some such cases, the power socket 116 may be compliant, for example, with ANSI/SAE Standard J563 (Standard for 12 Volt Cigarette Lighters, Power Outlets, and Accessory Plugs). In some other embodiments, a given power socket 116 may be configured, for example, as a threaded lamp socket, a multi-pin socket (e.g., bi-pin, tri-pin, or other), a twist-lock mount socket, or a bayonet connector socket, among others. In some still other embodiments, a given power socket 116 may be configured, for example, as a simple punched sheet metal hole with any desired arrangement of electrical connections. In some cases, a given power socket 116 of luminaire 100 may be configured such that it is compliant, for example, with one or more Zhaga Consortium standards. As will be appreciated in light of this disclosure, the quantity and arrangement of power socket(s) 116 can be customized, as desired for a given target application or end-use. In addition, the power socket(s) 116 of luminaire 100 can be wired in parallel or in series, in part or in whole, as desired. In some embodiments, a given power socket 116 may be configured, for example, to electrically short if a solid-state light source 120, a filler plug 117 (discussed below), or other designated element is not inserted therein or otherwise interfaced therewith.

In some embodiments, a given power socket 116 may be configured to facilitate heat dissipation for a given solid-state light source 120 operatively interfaced therewith. To that end, a given power socket 116 may be constructed, in part or in whole, from a thermally conductive material, such as any of the example materials discussed above, for instance, with respect to housing 110. In some cases, a given power socket 116 may be configured to be physically coupled, thermally coupled, or both, with housing 110, a heat sink portion 130 (discussed below) of a given solid-state light source 120 operatively interfaced therewith, or both. Other suitable configurations for the power socket(s) 116 of luminaire 100 will depend on a given application and will be apparent in light of this disclosure.

In accordance with some embodiments, power socket(s) 116 optionally may be disposed over or within a frame 115 or other suitable support structure. Optional frame 115 may be constructed, in part or in whole, from a thermally conductive material, such as any of the example materials discussed above, for instance, with respect to housing 110. In addition, the size and geometry of such a support structure can be customized as desired. In some cases, the optional support structure may be configured, for example, to be physically coupled, thermally coupled, or both, with housing 110, a heat sink portion 130 (discussed below) of a given solid-state light source 120 operatively interfaced therewith, or both. Other suitable configurations for a given optional support structure of luminaire 100 will depend on a given application and will be apparent in light of this disclosure.

In accordance with some other embodiments, power socket(s) 116 optionally may be disposed over or within a printed circuit board (PCB) 118 or other suitable intermediate or substrate. Interconnecting circuitry and other electronic componentry and devices associated with a given power socket 116 (e.g., for operative coupling with a driver 140, a controller 180, etc.) also optionally may be disposed over or within a given PCB 118, in accordance with some embodiments. In some cases, a given power socket 116 and its associated componentry may be configured as a surface-mount device (SMD) that is disposed over a given PCB 118, for example, via a surface mount technology (SMT) component placement system (e.g., a pick-and-place machine) or any other suitable means, as will be apparent in light of this disclosure. In accordance with some embodiments, a given PCB 118 may be constructed, in part or in whole, from a thermally conductive material, such as any of the example materials discussed above, for instance, with respect to housing 110. In some cases, a given PCB 118 may be physically coupled, thermally coupled, or both, with housing 110, a heat sink portion 130

(discussed below) of a given solid-state light source 120 operatively interfaced therewith, or both.

Figure 4A:
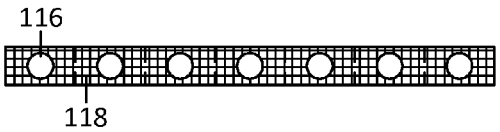
FIG. 4A illustrates a plan view of a printed circuit board (PCB) including a plurality of power sockets configured in accordance with an embodiment of the present disclosure.
Figure 4B:
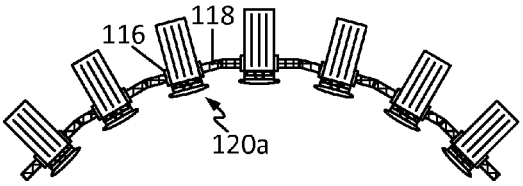
FIG. 4B illustrates a cross-sectional view of a plurality of solid-state light sources operatively interfaced with the power sockets of the PCB of FIG. 4A, in accordance with an embodiment of the present disclosure.
Figure 4C:
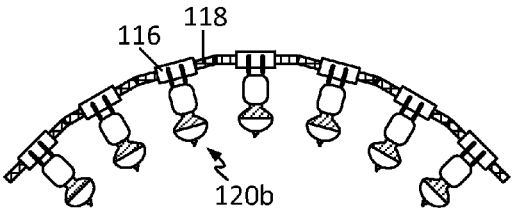
FIG. 4C illustrates a cross-sectional view of a plurality of solid-state light sources operatively interfaced with the power sockets of the PCB of FIG. 4A, in accordance with another embodiment of the present disclosure.

FIG. 4A illustrates a plan view of a PCB 118 including a plurality of power sockets 116 configured in accordance with an embodiment of the present disclosure. FIG. 4B illustrates a cross-sectional view of a plurality of solid-state light sources 120*a* operatively interfaced with the power sockets 116 of the PCB 118 of FIG. 4A, in accordance with an embodiment of the present disclosure. FIG. 4C illustrates a cross-sectional view of a plurality of solid-state light sources 120*b* operatively interfaced with the power sockets 116 of the PCB 118 of FIG. 4A, in accordance with another embodiment of the present disclosure. As can be seen from these figures, in some embodiments, a given PCB 118 may be formed, for example, as a sheet or strip configured to be bent or otherwise shaped as desired. To that end, a given PCB 118 may be flexible or articulated (e.g., with one or more joints or other points of defined flexing), in accordance with some embodiments. In some embodiments, a given PCB 118 may be flat or otherwise substantially planar. In some cases, power socket(s) 116 may be tilted in angle with respect to a given PCB 118, for example, to allow the beam angles of each solid-state light source 120 to diverge or converge, providing for a tunable angular distribution, as desired for a given target application or end-use.

Figure 5A:
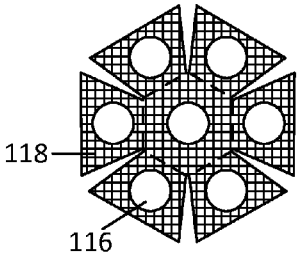
FIGS. 5A-5B illustrate plan views of a foldable PCB in its unfolded and folded states, respectively, in accordance with another embodiment of the present disclosure.
Figure 5B:
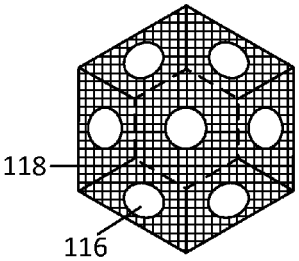
Figure 5C:
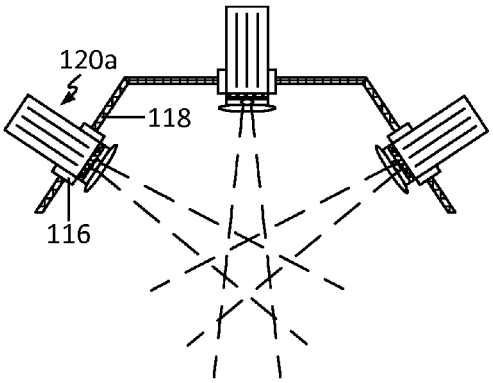
FIG. 5C illustrates a cross-sectional view of a plurality of solid-state light sources operatively interfaced with the power sockets of the folded PCB of FIG. 5B, in accordance with an embodiment of the present disclosure.
Figure 5D:
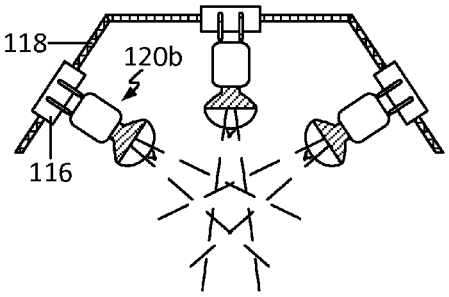
FIG. 5D illustrates a cross-sectional view of a plurality of solid-state light sources operatively interfaced with the power sockets of the folded PCB of FIG. 5B, in accordance with another embodiment of the present disclosure.

The present disclosure is not so limited, however, as in some other embodiments a given PCB 118 may be formed as a patterned piece configured to be folded, collapsed, or both, as desired. For instance, consider FIGS. 5A-5B, which illustrate plan views of a foldable PCB 118 in its unfolded and folded states, respectively, in accordance with another embodiment of the present disclosure. FIG. 5C illustrates a cross-sectional view of a plurality of solid-state light sources 120*a* operatively interfaced with the power sockets 116 of the folded PCB 118 of FIG. 5B, in accordance with an embodiment of the present disclosure. FIG. 5D illustrates a cross-sectional view of a plurality of solid-state light sources 120*b* operatively interfaced with the power sockets 116 of the folded PCB 118 of FIG. 5B, in accordance with another embodiment of the present disclosure. In a more general sense, a given PCB 118 may be faceted, articulated, flexible, or otherwise configured to substantially conform (e.g., within a given tolerance) to the contour of a given surface of housing 110 (e.g., interior surface 112; exterior surface 114). Numerous configurations for the one or more PCBs 118 of luminaire 100 will be apparent in light of this disclosure.

Figure 6A:
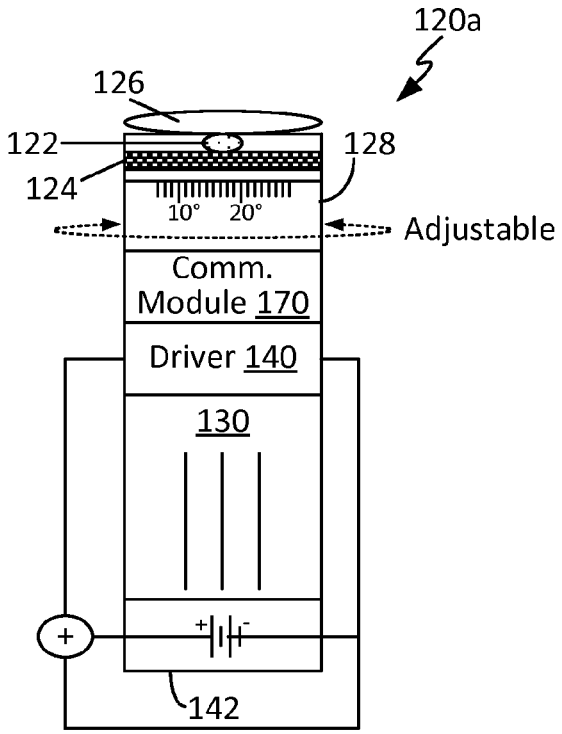
FIG. 6A is a side view of a solid-state light source configured in accordance with an embodiment of the present disclosure.
Figure 6B:
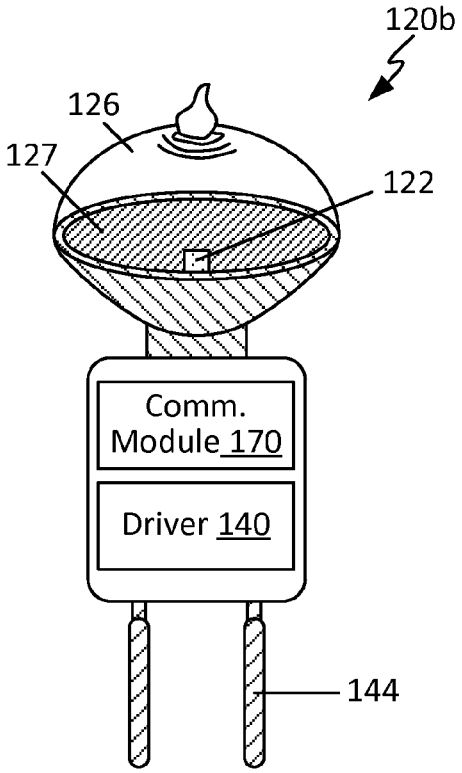
FIG. 6B is a perspective view of a solid-state light source configured in accordance with another embodiment of the present disclosure.

As noted above, the power sockets 116 of luminaire 100 may be configured to operatively interface with solid-state light sources 120, in accordance with some embodiments. FIG. 6A is a side view of a solid-state light source 120*a* configured in accordance with an embodiment of the present disclosure. FIG. 6B is a perspective view of a solid-state light source 120*b* configured in accordance with another embodiment of the present disclosure. For consistency and ease of understanding of the present disclosure, solid-state light sources 120*a* and 120*b* may be collectively referred to generally as a solid-state light source 120, except where separately referenced.

A given solid-state light source 120 may be configured, in accordance with some embodiments, to operatively interface with a given power socket 116, for example, to draw power therefrom and for control of its output, and can have any of a wide range of configurations to that end. For instance, in some embodiments, such as that shown in FIG. 6A, a given solid-state light source 120 may have a generally flashlight-like insert configuration that can be inserted within or otherwise operatively interfaced with a given power socket 116. In some embodiments, a given solid-state light source 120 may be configured like a cigarette lighter plug or other auxiliary power plug as may be utilized in conjunction with an automobile's cigarette lighter receptacle or other automotive auxiliary DC power outlet. In some such cases, the solid-state light source 120 may be configured for operative interfacing with a power socket 116 that is compliant, for example, with ANSI/SAE Standard J563 (Standard for 12 Volt Cigarette Lighters, Power Outlets, and Accessory Plugs). In some other embodiments, such as that shown in FIG. 6B, a given solid-state light source 120 may be configured as a multi-pin (e.g., bi-pin, tri-pin, or other) solid-state lamp including a plurality of pins 144, such as an OSRAM MINISTAR™ Lamp, available from Osram Sylvania, Inc. In some still other embodiments, a given solid-state light source 120 may be configured, for example, with a threaded base including an electrical foot contact, a twist-lock mount base, or a bayonet connector base, among others. In a more general sense, the geometry and dimensions of a given solid-state light source 120 can be customized such that that solid-state light source 120 may be of any standard, custom, or proprietary fitting size for use with a given power socket 116, as desired for a given target application or end-use.

In accordance with some embodiments, to help dissipate heat to the ambient environment, operative interfacing of a given solid-state light source 120 with a given power socket 116 may provide a thermal pathway, for example, between its PCB 124 and solid-state emitter(s) 122 populated thereon (discussed below) and housing 110. Furthermore, a given solid-state light source 120 may be constructed, in part or in whole, from a thermally conductive material, such as any of the example materials discussed above, for instance, with respect to housing 110.

In accordance with some embodiments, a given solid-state light source 120 may include one or more solid-state emitters 122. A given solid-state emitter 122 may be any semiconductor light source device, such as, for example, a light-emitting diode (LED), an organic light-emitting diode (OLED), a polymer light-emitting diode (PLED), or a combination thereof, among others. A given solid-state emitter 122 may be configured to emit electromagnetic radiation (e.g., light), for example, from the visible spectral band, the infrared (IR) spectral band, the ultraviolet (UV) spectral band, or a combination thereof, among others. In some embodiments, a given solid-state emitter 122 may be configured for emissions of a single correlated color temperature (CCT) (e.g., a white light-emitting semiconductor light source). In some other embodiments, a given solid-state emitter 122 may be configured for color-tunable emissions; for instance, a given solid-state emitter 122 may be a multi-color (e.g., bi-color, tri-color, etc.) semiconductor light source configured for a combination of emissions, such as red-green-blue (RGB), red-green-blue-yellow (RGBY), red-green-blue-white (RGBW), dual-white, or a combination thereof, among others. In some cases, a given solid-state emitter 122 may be configured, for example, as a high-brightness semiconductor light source. In some embodiments, a given solid-state emitter 122 of luminaire 100 may be provided with a combination of any one or more of the aforementioned example emissions capabilities.

In accordance with some embodiments, a given solid-state light source 120 of luminaire 100 may include a laser diode solid-state emitter 122 and may be configured to utilize a laser-activated remote phosphor (LARP). As will be appreciated in light of this disclosure, laser diodes typically have a small source size and a small angular deviation. As will be further appreciated, however, it may be desirable, in some instances, to provide solid-state light sources 120 having low & endue, high radiance, or both, for efficient optical coupling. Thus, and in accordance with some embodiments, a given solid-state light source 120 employing LARP may utilize one or more short-wavelength laser diode solid-state emitters 122 to excite a remote phosphor, for instance, that down-converts the incident light to longer wavelength(s). In some cases, this may help to provide high radiance for light over a broader target spectral range than may be provided solely by a laser diode solid-state emitter 122 having emissions within a generally narrow spectral region. In some instances, a small beam spot size, and therefore a low &endue, may be provided, for example, by focusing, concentrating, or both, the laser light emitted by the laser diode solid-state emitter 122 onto the remote phosphor. In an example embodiment, the phosphor may be embedded in a reflective surface such that backward-directed luminescent light is returned back in the direction of the laser diode solid-state emitter 122 by traversing back through the phosphor.

In accordance with some embodiments, a given solid-state emitter 122 may be configured to be individually addressable, addressable in one or more groupings, or both. As such, the solid-state light source(s) 120 of luminaire 100 can be electronically controlled individually, in conjunction with one another, or both, providing luminaire 100 with an electronically adjustable light beam distribution capable of highly adjustable light emissions, in accordance with some embodiments. Other suitable configurations for the one or more solid-state emitters 122 of a given solid-state light source 120 will depend on a given application and will be apparent in light of this disclosure.

The solid-state emitter(s) 122 of a given solid-state light source 120 can be packaged or non-packaged, as desired, and in some cases may be populated on a printed circuit board (PCB) 124 or other suitable intermediate or substrate. In some embodiments, all (or some sub-set) of the solid-state emitters 122 of a given solid-state light source 120 may have their own associated PCBs 124. In some such cases, all (or some sub-set) of those PCBs 124 may be interconnected with one another, for example, via interconnecting wires or any other suitable interconnection means, as will be apparent in light of this disclosure. In some embodiments, all (or some sub-set) of the solid-state emitters 122 of a given solid-state light source 120 may share a single PCB 124. In some such cases, the shared PCB 124 may be folded, faceted, articulated, flexible, or otherwise configured to aim the solid-state emitters 122 of the solid-state light source 120 as desired. In some cases, a given PCB 124 may include additional componentry (e.g., resistors, transistors, integrated circuits, etc.) populated thereon. In some instances, the power and control connections for a given solid-state emitter 122 may be routed from a given PCB 124 to a driver 140 (discussed below) or other device or componentry, as desired. Other suitable configurations for the one or more PCBs 124 of a given solid-state light source 120 will depend on a given application and will be apparent in light of this disclosure.

The optic(s) 126 of a given solid-state light source 120 may be configured to transmit the one or more wavelengths of interest of the light (e.g., visible, UV, IR, etc.) emitted by solid-state emitter(s) 122 optically coupled therewith. To that end, optic(s) 126 may include an optical structure (e.g., a window, lens, dome, etc.) formed from any suitable optical material, such as, for example, a polymer such as poly(methyl methacrylate) (PMMA) or polycarbonate, a ceramic such as sapphire ($Al_2O_3$) or yttrium aluminum garnet (YAG), a glass, or a combination thereof, among others. In some cases, the optic(s) 126 of a given solid-state light source 120 may be formed from a single (e.g., monolithic) piece of optical material to provide a single, continuous optical structure. In some other cases, the optic(s) 126 of a given solid-state light source 120 may be formed from multiple pieces of optical material to provide a multi-piece optical structure. In some instances, the optic(s) 126 of a given solid-state light source 120 may be integrated, in part or in whole, with a given solid-state emitter 122 thereof. The size and geometry of the optic(s) 126 of a given solid-state light source 120 can be customized, as desired for a given target application or end-use.

The optic(s) 126 of a given solid-state light source 120 may be configured, in accordance with some embodiments, to focus, collimate, or both, light transmitted therethrough. In some cases, optic(s) 126 may include a narrow focusing lens, a fisheye lens, or both, which may be configured as typically done. In some embodiments, optic(s) 126 may include one or more optical structures (e.g., prismatic structures) configured to cause light beams exiting optic(s) 126 to converge or diverge, as desired, such that the light beams produced by a host luminaire 100 have a minimal, maximal, or other given degree of beam spot overlap. Such optical structures may be embedded, surficial, or both. In some cases, the optic(s) 126 of a given solid-state light source 120 may include optical features, such as, for example, an anti-reflective (AR) coating, a reflector, a diffuser, a polarizer, a brightness enhancer, a phosphor material that converts light received thereby to light of a different wavelength, or a combination thereof, among others.

In some embodiments, a given solid-state light source 120 may be configured for interchangeable optics 126 that can be swapped, as desired for a given target application or end-use. In some embodiments, a given solid-state light source 120 may be configured such that all of its constituent solid-state emitters 122 share its optic(s) 126. In some other embodiments, however, a given solid-state light source 120 may be configured such that a first sub-set of its constituent solid-state emitters 122 shares a first sub-set of optic(s) 126, whereas a second sub-set of its constituent solid-state emitters 122 shares a second, different sub-set of optic(s) 126. In some embodiments, a given solid-state light source 120 may be configured such that each of its constituent solid-state emitters 122 is optically coupled with its own unique or otherwise dedicated optic(s) 126. In some embodiments, all (or some sub-set) of the solid-state emitter(s) 122 of a given solid-state light source 120 may be configured with optic(s) 126 that cause the light output of all (or some sub-set) of those solid-state light emitter(s) 122 to diverge or converge as it exits those optic(s) 126. Other suitable configurations for the optic(s) 126 of a given solid-state light source 120 will depend on a given application and will be apparent in light of this disclosure.

In some embodiments, such as that of FIG. 6B, a given solid-state light source 120 optionally may include a reflector portion 127. Optional reflector portion 127 may be an axial reflector, a side reflector, or other reflector configured as typically done. Optional reflector portion 127 may be formed, in part or in whole, from a reflective material, such as, for example, silver (Ag), gold (Au), aluminum (Al), or a combination thereof, among others. Other suitable configurations for optional reflector portion 127 will depend on a given application and will be apparent in light of this disclosure.

In accordance with some embodiments, a given solid-state light source 120 optionally may include a beam angle adjuster 128. Optional beam angle adjuster 128 may be configured, for example, to electronically adjust, mechanically adjust, or both, the beam angle of the solid-state emitter(s) 122 of a host solid-state light source 120. Such adjustment via optional beam angle adjuster 128 may be performed automatically (e.g., via a controller 180, discussed below), manually (e.g., by a user), or both, and the increments of adjustment can be customized, as desired for a given target application or end-use. Other suitable configurations for optional beam angle adjuster 128 will depend on a given application and will be apparent in light of this disclosure.

In accordance with some embodiments, a given solid-state light source 120 may be electronically coupled with one or more drivers 140 configured for use in controlling the output of its solid-state emitter(s) 122. A given driver 140 may be, for example, a single-channel or multi-channel electronic driver. In some embodiments, a given driver 140 may be separate from a given solid-state light source 120 and operatively coupled therewith, for example, via a power socket 116 with which that light source 120 is operatively interfaced (e.g., as in FIGS. 2A-2B). In some other embodiments, a given driver 140 may be integrated with or otherwise on-board a given solid-state light source 120 (e.g., as in FIGS. 6A-6B). In some cases, a given driver 140 may be controlled, in part or in whole, via a controller 180 (discussed below) using any suitable wired or wireless communication means.

In accordance with some embodiments, a given driver 140 may be configured to control the output of a given solid-state emitter 122 or grouping thereof. For instance, driver 140 may be configured to control the on/off state, dimming level, color of emissions, correlated color temperature (CCT), color saturation, or a combination thereof, among others. To such ends, driver 140 may utilize any suitable driving technique, such as, for example, a pulse-width modulation (PWM) dimming protocol, a current dimming protocol, a triode for alternating current (TRIAC) dimming protocol, a constant current reduction (CCR) dimming protocol, a pulse-frequency modulation (PFM) dimming protocol, a pulse-code modulation (PCM) dimming protocol, a line voltage (mains) dimming protocol where the dimmer is connected before the input of driver 140 to adjust AC voltage to driver 140, or a combination thereof, among others. In an example case, a given driver 140 may be an OSRAIVI ET-LED 2W-30W 12V Electronic Transformer Ballast Driver, available from Osram Sylvania, Inc. In accordance with some embodiments, a given driver 140 may be configured to serve as the voltage source for one or more of the power sockets 116 of luminaire 100, which, as previously noted, can be wired in parallel or in series, as desired. In some embodiments, power sockets 116 of luminaire 100 may be wired in series, and a constant current driver 140 may be operatively coupled therewith. In some such cases, power sockets 116 may be configured to electrically short if a solid-state light source 120, filler plug 117 (discussed below), or other suitable element is omitted from any one of that plurality. Other suitable configurations for a given driver 140 and lighting control and driving techniques will depend on a given application and will be apparent in light of this disclosure.

In accordance with some embodiments, a given solid-state light source 120 optionally may include an integrated or otherwise on-board energy storage device 142, such as, for example, a battery, a supercapacitor (e.g., an ultracapacitor), or a combination thereof. In some embodiments, optional energy storage device 142 may be electrically coupled with a driver 140 that is also integrated with or otherwise on-board that solid-state light source 120 (e.g., as in FIG. 6A). In some embodiments, optional energy storage device 142 may be electrically coupled with a driver 140 that is separate from solid-state light source 120 (e.g., as in FIGS. 2A-2B). Other suitable configurations for a given optional energy storage device 142 will depend on a given application and will be apparent in light of this disclosure.

In some embodiments, a given solid-state light source 120 optionally may include a heat sink portion 130 (e.g., as in FIG. 6A) that is configured to facilitate heat dissipation for the solid-state light emitter(s) 122 of that light source 120. To that end, optional heat sink portion 130 may be constructed, in part or in whole, from a thermally conductive material, such as any of the example materials discussed above, for instance, with respect to housing 110. Optional heat sink portion 130 may include any feature typically utilized in heat management for electronic components, and in some embodiments may include arrangement of fins, foils, or both. Other suitable configurations for the optional heat sink portion 130 of a given solid-state light source 120 will depend on a given application and will be apparent in light of this disclosure.

In accordance with some embodiments, luminaire 100 optionally may include a communication module 170. Optional communication module 170 may be configured for wired or wireless communication (or both) utilizing any suitable means, such as Universal Serial Bus (USB), Ethernet, FireWire, Wi-Fi, Bluetooth, or a combination thereof, among others. In some cases, optional communication module 170 may be configured to transmit or receive signals (or both), for example, pertaining to data such as temperature, period of operation, or any other desired information. In accordance with some embodiments, optional communication module 170 may be configured to be utilized with a PLC module 148, a given driver 140, a given controller 180 (discussed below), a control interface 200 (discussed below), or a combination thereof, in controlling a given solid-state light source 120 operatively interfaced with a given power socket 116. Other suitable configurations for optional communication module 170 will depend on a given application and will be apparent in light of this disclosure.

In accordance with some embodiments, a given solid-state light source 120 optionally may include a communication module 172. Optional communication module 172 may be configured to be utilized with a PLC module 148, a given driver 140, a given controller 180 (discussed below), a control interface 200 (discussed below), or a combination thereof, in controlling a given solid-state light source 120 operatively interfaced with a given power socket 116. To such ends, communication module 172 may be provided with any of the example configurations discussed above, for instance, with respect to communication module 170. Other suitable configurations for optional communication module 172 will depend on a given application and will be apparent in light of this disclosure.

As will be appreciated in light of this disclosure, a given solid-state light source 120 also may include or otherwise be operatively coupled with other solid-state lighting circuitry and componentry. For instance, a given solid-state light source 120 may be configured to host or otherwise be operatively coupled with power conversion circuitry, such as electrical ballast circuitry to convert an AC signal into a DC signal at a desired current and voltage to power a given solid-state light source 120. A given solid-state light source 120 may be configured to host or otherwise be operatively coupled with constant current/voltage driver componentry. A given solid-state light source 120 may be configured to host or otherwise be operatively coupled with transmitter, receiver, or both transmitter and receiver (e.g., transceiver) componentry. A given solid-state light source 120 may be configured to host or otherwise be operatively coupled with internal processing componentry. In any such cases, such optional circuitry and componentry may be mounted, for instance, on one or more driver 140 boards integral to a given solid-state light source 120 or luminaire 100, in accordance with some embodiments.

In some embodiments, luminaire 100 optionally may include or otherwise be operatively coupled with a power-line communication (PLC) module 148. PLC module 148 may be configured to output one or more PLC signals and may be configured as typically done to that end. The PLC signal(s) may be received by a given driver 140, for example, over a common DC communication bus or other suitable interconnect. Driver 140 may utilize received PLC signal(s) in controlling the light output of a given solid-state light source 120 operatively coupled with it. In some embodiments, processor(s) 160 of luminaire 100 may interface between PLC module 148 and any incoming command signal(s) received via a communication module 170, for example, from a control interface 200 (e.g., via Wi-Fi, Bluetooth, Zigbee, DMX, etc.), discussed below. Such command signal(s) may be utilized in controlling the PLC signal output of PLC module 148.

The arrangement (e.g., quantity; density) of power sockets 116 for luminaire 100 may be customized, as desired for a given target application or end-use. The arrangement may be selected based on considerations such as, for example, the dimensions of housing 110, the geometry of housing 110, a target light distribution to be achieved via luminaire 100, or a combination thereof, among others. In some embodiments, such as those of FIGS. 2A-2B, luminaire 100 may be configured with one or more solid-state light sources 120 arranged over an interior surface 112 of housing 110 thereof and configured such that light beams emerging therefrom converge passing through a given aperture 15 in mounting surface 10. In some other embodiments, such as that of FIG. 3B, luminaire 100 may be configured with one or more solid-state light sources 120 arranged over an exterior surface 114 of housing 110 thereof and configured such that light beams emerging therefrom diverge. In either case, the angular spacing of the solid-state light source(s) 120 of luminaire 100 can be customized to provide any given light beam distribution, as desired for a given target application or end-use, and in some cases may be selected, at least in part, based on the amount of light beam overlap desired for the light distribution produced by luminaire 100. As will be appreciated in light of this disclosure, the wider the angular spacing, the further apart the resultant illumination patterns will be spaced on a given surface of incidence. Conversely, the narrower the angular spacing, the closer together the resultant illumination patterns will be spaced on a given surface of incidence. In some embodiments, luminaire 100 may include a plurality of solid-state light sources 120 arranged over housing 110 with substantially uniform (e.g., within a given tolerance) angular spacing. In some other embodiments, luminaire 100 may include a plurality of solid-state light sources 120 arranged over housing 110 with non-uniform angular spacing. In some cases, arrangement of solid-state light source(s) 120 over a housing 110 of hyper-hemispherical shape may allow for directing light into higher angles for coverage of a larger space. In any case, a given power socket 116 may be mounted to or otherwise arranged over a given surface of housing 110, for example, via one or more fasteners, a quantity of thermally conductive adhesive, a given optional PCB 118, or any other suitable coupling means, as will be apparent in light of this disclosure.

Figure 7A:
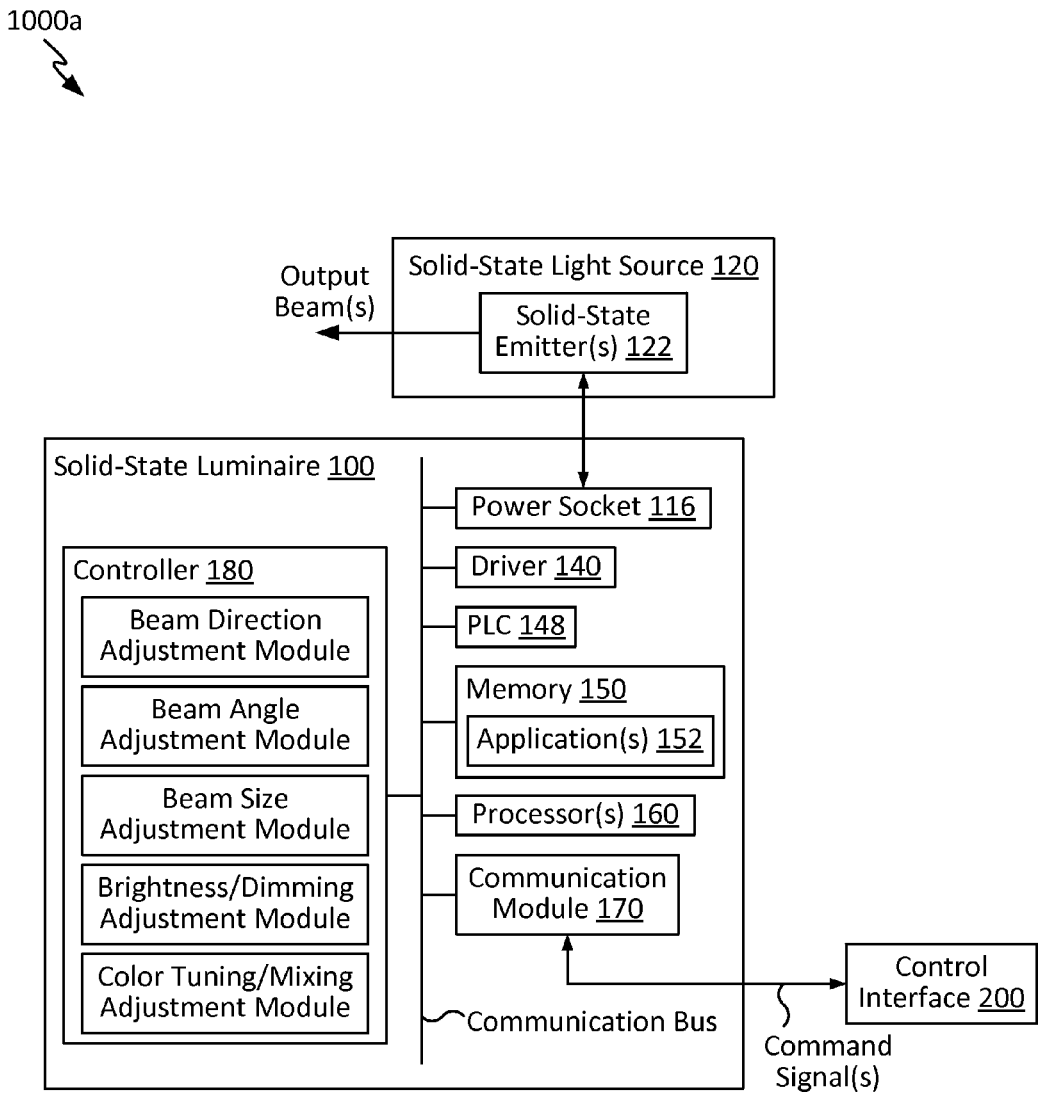
FIG. 7A is a block diagram of a lighting system configured in accordance with an embodiment of the present disclosure.
Figure 7B:
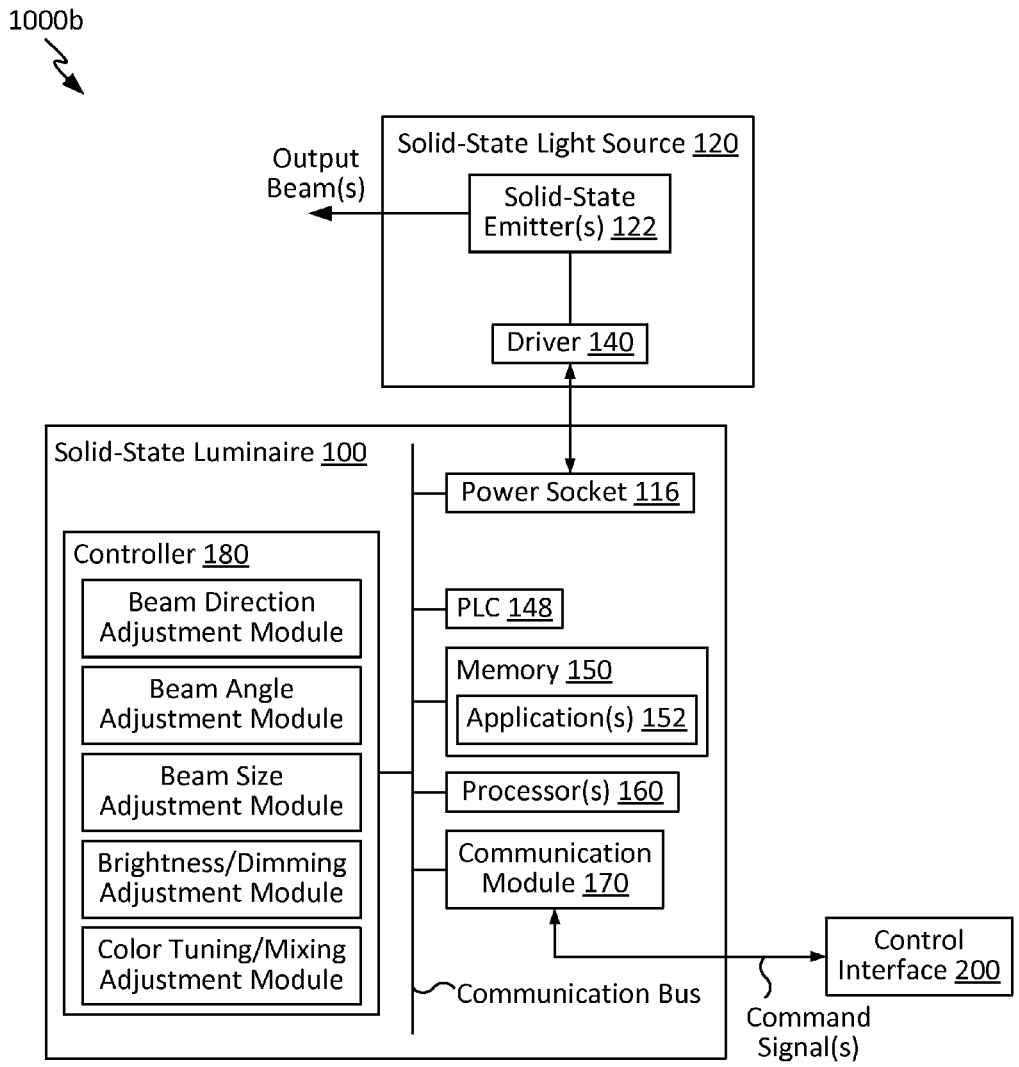
FIG. 7B is a block diagram of a lighting system configured in accordance with another embodiment of the present disclosure.
Figure 7C:
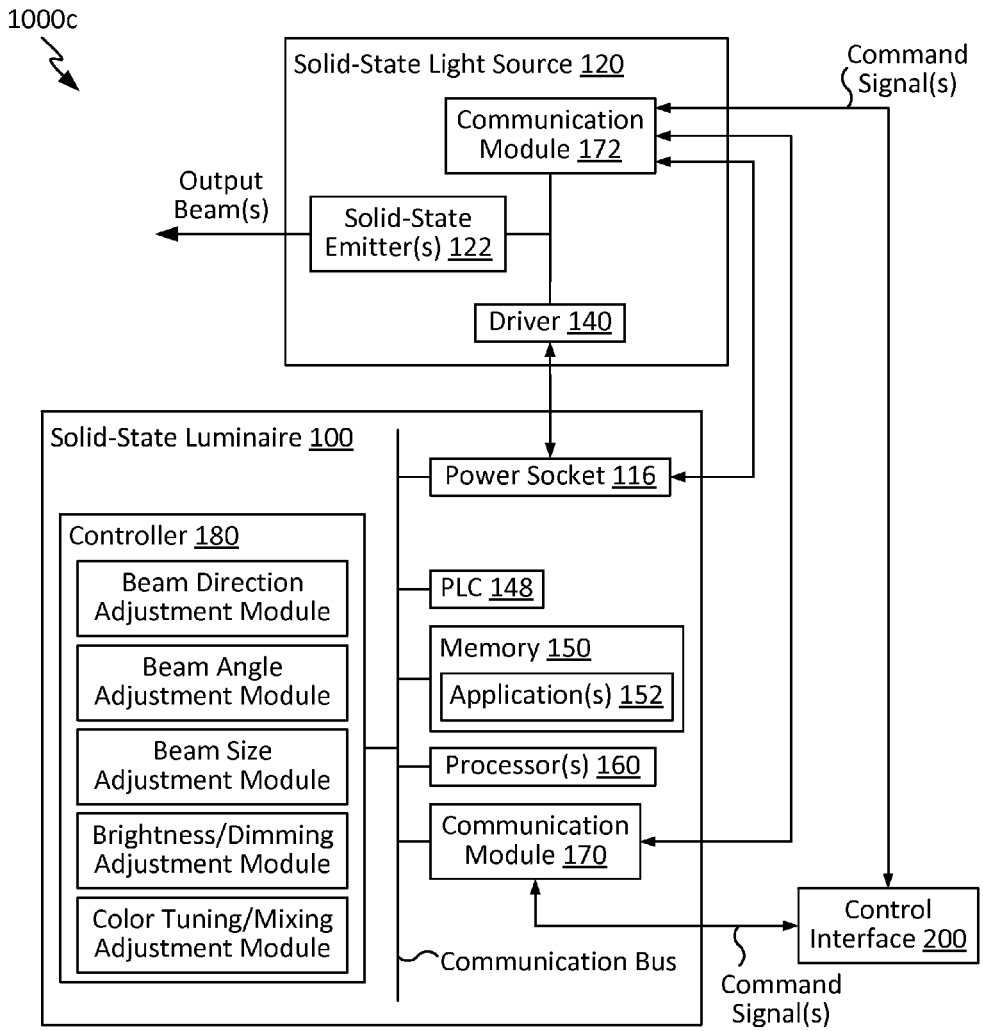
FIG. 7C is a block diagram of a lighting system configured in accordance with another embodiment of the present disclosure.

Also, as can be seen from FIGS. 7A-7C (discussed below), luminaire 100 may include memory 150 and one or more processor(s) 160. Memory 150 can be of any suitable type (e.g., RAM, ROM, a combination thereof, or other suitable memory) and size, and in some cases may be implemented with volatile memory, non-volatile memory, or a combination thereof. A given processor 160 of luminaire 100 may be configured as typically done, and in some embodiments may be configured, for example, to perform operations associated with luminaire 100 and one or more of the modules thereof (e.g., within memory 150 or elsewhere). In some cases, memory 150 may be configured to be utilized, for example, for processor workspace (e.g., for one or more processors 160). In some cases, memory 150 may be configured, for example, to store media, programs, applications, content, or a combination of any one or more thereof, on a host luminaire 100 on a temporary or permanent basis, as desired for a given target application or end-use.

In accordance with some embodiments, the one or more modules stored in memory 150 can be accessed and executed, for example, by the one or more processors 160 of luminaire 100. A given module of memory 150 can be implemented in any suitable standard, custom, or proprietary programming language, such as, for example, C, C++, objective C, JavaScript, or any other suitable instruction set, as will be apparent in light of this disclosure. The modules of memory 150 can be encoded, for example, on a machine-readable medium that, when executed by a processor 160, carries out the functionality of luminaire 100, in part or in whole. The computer-readable medium may be, for example, a hard drive, a compact disk, a memory stick, a server, or any suitable non-transitory computer or computing device memory that includes executable instructions, or a plurality or combination of such memories. Some embodiments can be implemented, for instance, with gate-level logic, an application-specific integrated circuit (ASIC) or chip set, or other such purpose-built logic. Some embodiments can be implemented with a microcontroller having input/output capability (e.g., inputs for receiving user inputs; outputs for directing other components) and a number of embedded routines for carrying out device functionality. In a more general sense, the functional modules of memory 150 (e.g., one or more applications 152) can be implemented in hardware, software, firmware, or a combination of any one or more thereof, as desired for a given target application or end-use.

In accordance with some embodiments, memory 150 may have stored therein or otherwise have access to one or more applications 152 or other functional modules. In some instances, luminaire 100 may be configured to receive input, for example, via one or more applications 152 stored in memory 150. Other suitable modules, applications, and data which may be stored in memory 150 (or may be otherwise accessible to luminaire 100) will depend on a given application and will be apparent in light of this disclosure.

Example Installations

In some embodiments, luminaire 100 may be configured to be mounted to a mounting surface 10 such as, for example, a ceiling, drop ceiling tile configured for installation in any standard or custom drop ceiling grid, wall, floor, or step, among others. Such mounting may be provided in a temporary or permanent manner, as desired. In some cases, luminaire 100 may be in direct physical contact with mounting surface 10. In some other cases, an intermediate structure, such as a support plate, a support rod, or other suitable support structure, may be disposed between luminaire 100 and mounting surface 10. In some cases, luminaire 100 may be configured as a recessed lighting fixture for mounting in mounting surface 10 (e.g., such as is generally depicted in FIGS. 1A-1B). In some other cases, luminaire 100 may be configured as a pendant-type, a sconce-type, or other suspended or extended fixture for mounting on mounting surface 10 (e.g., such as is generally depicted in FIG. 3A). In some other embodiments, luminaire 100 may be configured as a free-standing or otherwise portable lighting device, such as a desk lamp or a torchière lamp, for example. Numerous suitable configurations will be apparent in light of this disclosure.

In some cases, mounting surface 10 may have one or more apertures 15 formed therein that pass through the thickness of mounting surface 10 (e.g., from a first side 12*a* to an opposing side 12*b* thereof). In accordance with some embodiments, luminaire 100 may be positioned relative to such aperture(s) 15 such that light emitted by solid-state light source(s) 120 emerges from luminaire 100 with minimal or otherwise negligible overlap with the perimeter of a given aperture 15, thus helping to ensure that substantially all of the light emitted by solid-state light source(s) 120 exits luminaire 100. In some instances, a given aperture 15 may host an optical structure configured to adjust the light output of luminaire 100, such as, for example, a focusing lens, a collimating lens, a diffuser sheet configured to blend beam spots, or a combination thereof, among others.

The geometry and size of a given aperture 15 may be customized, as desired for a given target application or end-use. In some instances, the geometry and size of a given aperture 15 may be generally commensurate with the geometry and dimensions of luminaire 100 and its particular arrangement of solid-state light source(s) 120. For example, if housing 110 is hemispherical, then an aperture 15 may be substantially circular. If housing 110 is oblate hemispherical, then an aperture 15 may be substantially elliptical. In some cases, a given aperture 15 may have a width/diameter, for example, in the range of about 1-10 inches (e.g., about 1-5 inches, about 5-10 inches, or any other sub-range in the range of about 1-10 inches). In some example cases, aperture 15 may have a width/diameter of about 4 inches±2 inches. In some other cases, a given aperture 15 may have a width/diameter, for example, greater than about 10 inches (e.g., about 10-15 inches, about 15-20 inches, or greater). In some instances, a given aperture 15 may be smaller in size than the distribution area of the solid-state light source(s) 120 of luminaire 100. Thus, in some instances, such an aperture 15 may be smaller in size than the light field of luminaire 100; that is, it may be smaller than the physical distribution area of the solid-state emitter(s) 122 of its solid-state light source(s) 120. Also, in some cases, a given aperture 15 may be configured such that one or more of the light beams produced by the solid-state light source(s) 120 of luminaire 100 pass through a focal point generally located within that aperture 15. Other suitable configurations for a given aperture 15 formed in mounting surface 10 will depend on a given application and will be apparent in light of this disclosure.

In some cases, a trim 150, such as a bezel, collar, or baffle, optionally may be utilized with luminaire 100. Optional trim 150 may be configured to reside within, about, or both, a given aperture 15, adjacent a second side 12*b* of mounting surface 10. Trim 150 may have aperture(s) 155 formed therein that generally correspond in quantity, geometry, and dimensions with the aperture(s) 15 formed in mounting surface 10. The shape and dimensions of a given aperture 155 may be customized, as desired for a given target application or end-use. In some cases, the shape and dimensions may be substantially the same as (e.g., within a given tolerance) a given aperture 15 in mounting surface 10. In some cases, a given aperture 155 may be smaller in size than the distribution area of solid-state light source(s) 120 operatively interfaced with luminaire 100. Thus, in some instances, that aperture 155 may be smaller in size than the light field of luminaire 100; that is, it may be smaller than the physical distribution area of solid-state emitters 122 over housing 110. In some cases, a given aperture 15 formed within a mounting surface 10 may be provided with a geometry and size like that of a given aperture 155 of optional trim 150. Also, in some embodiments, a given aperture 155 may be configured such that one or more of the light beams produced by the solid-state light sources 120 of luminaire 100 pass through a focal point generally located within that aperture 155. Other suitable configurations for optional trim 150 and its one or more apertures 155 will depend on a given application and will be apparent in light of this disclosure.

Output Control

In accordance with some embodiments, the solid-state light source(s) 120 hosted by luminaire 100 may be controlled to produce static or dynamic light distributions, as desired. More generally, the light distribution of luminaire 100 can be tailored for a particular space or lighting application of interest, and adjustment of the light output of luminaire 100 to that end may be performed automatically, manually, or both, as desired. As previously noted, the solid-state emitter(s) 122 of a given solid-state light source 120 may be configured, in accordance with some embodiments, to be electronically controlled individually, in conjunction with one another (e.g., as one or more groupings of emitters 122), or both. To such ends, a given solid-state emitter 122 may be configured to be individually addressable, addressable in one or more groupings, or both. Thus, as will be appreciated in light of this disclosure, any of a wide range of control techniques may be utilized in controlling the output of a given solid-state light source 120. FIG. 7A is a block diagram of a lighting system 1000*a* configured in accordance with an embodiment of the present disclosure. FIG. 7B is a block diagram of a lighting system 1000*b* configured in accordance with another embodiment of the present disclosure. FIG. 7C is a block diagram of a lighting system 1000*c* configured in accordance with another embodiment of the present disclosure.

In accordance with some embodiments, the output of a given solid-state emitter 122 of a given solid-state light source 120 may be controlled, at least in part, via a driver 140. As previously discussed, a given driver 140 may be a single-channel or multi-channel driver configured to use any suitable driving protocol. In some instances, the output of a given driver 140 may be based, at least in part, on a command signal or other input received, for example, from memory 150, a control interface 200 (discussed below), a communication module 170 or 172, or a combination thereof. Other suitable configurations for a given driver 140 will depend on a given application and will be apparent in light of this disclosure.

In accordance with some embodiments, the output of a given solid-state emitter 122 of a given solid-state light source 120 may be controlled, at least in part, via a controller 180. A given controller 180 may host one or more lighting control modules and can be programmed or otherwise configured to output one or more control signals that may be utilized in controlling the operation of a given solid-state emitter 122. A given controller 180 may be configured to communicate via any suitable digital communications protocol, wired or wireless, such as, for example, a digital multiplexer (DMX) interface protocol, a Wi-Fi protocol, a Bluetooth protocol, a digital addressable lighting interface (DALI) protocol, a ZigBee protocol, or a combination thereof, among others. In some instances, the control signal output of a given controller 180 may be based, at least in part, on a command signal or other input received, for example, from memory 150, a control interface 200 (discussed below), a communication module 170 or 172, or a combination thereof.

In some cases, a given controller 180 may output control signal(s) for use in controlling whether the light beam of a given solid-state emitter 122 is on/off. In some cases, a given controller 180 may output control signal(s) for use in controlling the beam direction of a given solid-state emitter 122. In some cases, a given controller 180 may output control signal(s) for use in controlling the beam angle of a given solid-state emitter 122. In some cases, a given controller 180 may output control signal(s) for use in controlling the beam size (e.g., beam width/diameter) of a given solid-state emitter 122. In some cases, a given controller 180 may output control signal(s) for use in controlling the beam distribution of a given solid-state emitter 122. In some cases, a given controller 180 may output control signal(s) for use in controlling the intensity (e.g., brightness or dimness) of emissions of a given solid-state emitter 122. In some cases, a given controller 180 may output control signal(s) for use in controlling the color of emissions (e.g., for color mixing/tuning) of a given solid-state emitter 122; that is, if a given solid-state light source 120 includes two or more solid-state emitters 122 configured to emit light having different wavelengths, the control signal may be used to adjust the relative brightness of the different solid-state emitters 122 in order to change the mixed color output by that solid-state light source 120. In some instances in which a given solid-state light source 120 is configured for multi-colored emissions, such a source 120 may be electronically controlled via controller 180 so as to adjust the color of light distributed at different angles, directions, or both.

In some cases, controller 180 may be hosted by luminaire 100. Here, the control signal output of controller 180 may be provided to a given solid-state emitter 122, for example, through a power socket 116 with which its host solid-state light source 120 is operatively interfaced, through communicative coupling between communication modules 170 and 172, or both. In some other cases, controller 180 may be hosted by the solid-state light source 120 (e.g., populated on one or more PCBs 124 of the host solid-state light source 120). Here, the control signal output of controller 180 may be provided to a given solid-state emitter 122, for example, through a communication bus or other interconnect hosted by solid-state light source 120. In some instances, all (or some sub-set) of solid-state light sources 120 operatively interfaced with luminaire 100 may include its own controller 180. Thus, each such controller 180 may be considered, in a sense, a mini-controller, providing an overall distributed controller 180. Other suitable configurations for a given controller 180 will depend on a given application and will be apparent in light of this disclosure.

In accordance with some embodiments, the light beam distribution resulting from luminaire 100 may depend, at least in part, on the position and orientation of each solid-state light source 120 hosted thereby. Thus, it may be desirable, in some instances, for processor(s) 160, application(s) 152, or both, to be aware of the position and orientation of each solid-state light source 120 to facilitate electronic control of the light beam distribution of luminaire 100. To that end, the location of each power socket 116 of luminaire 100 may be hardwired into processor(s) 160, pre-programmed into application(s) 152, or both, in accordance with some embodiments. In an example case, each power socket 116 may be associated with a unique input pin on a processor 160 (or other integrated circuit of luminaire 100) via a power connection or through an additional sense wire connection. Detection of operative interfacing between a given power socket 116 and a given solid-state light source 120 can be achieved, for example, by sensing the open/closed circuit condition via a drop in resistance. Data pertaining to the position and orientation of a given power socket 116 (and thus of a solid-state light source 120 operatively interfaced therewith) may be processed, for example, via processor(s) 160.

In accordance with another embodiment, operative interfacing of a solid-state light source 120 with a given power socket 116 may initiate a signal to processor(s) 160 to register the new connection. Such transmission may be provided via a PLC signal, a wired or wireless signal sent via communication module 172, or any other suitable communication technique. When luminaire 100 is powered on, the connection also may power the solid-state light source 120. During the initial powering on of that solid-state light source 120, it may send a signal to processor(s) 160 via the power socket 116 with which it is operatively interfaced. If the location of that power socket 116 is already known to luminaire 100 (e.g., to a given processor 160, application 152, or both), then so, too, is the location of a solid-state light source 120 operatively interfaced therewith.

In accordance with another embodiment, each power socket 116 may have a unique radio-frequency identification (RFID) address that is read by the solid-state light source 120 upon operative interfacing therewith. In such cases, when a solid-state light source 120 is operatively interfaced with a power socket 116, it may respond to command signals received only by the address of that particular power socket 116. If confirmation of operative interfacing between a solid-state light source 120 and a power socket 116 is desired, then the solid-state light source 120 may transmit its RFID and the RFID of the power socket 116 to processor(s) 160, application(s) 152, or both, to confirm that it has been installed at the location of that particular power socket 116. Such transmission may be provided via a PLC signal, a wired or wireless signal sent via communication module 172, or any other suitable communication technique. In some instances, the RFID addresses and power socket 116 locations may be known a priori, as they may be assigned during assembly of luminaire 100. As will be appreciated in light of this disclosure, under this approach, each power socket 116 need not have a hardwired connection to processor(s) 160, as communication may be provided, for example, if DC power is present.

In accordance with another embodiment, an image of luminaire 100 may be captured, for example, via a computing device, mobile or otherwise, having an image capture device, such as a still camera or a video camera, which may be configured as typically done. The captured image of luminaire 100 may be analyzed (e.g., utilizing object detection or other suitable means) to determine which power sockets 116 are bare and which have solid-state light sources 120 operatively interfaced therewith. In some cases, the computing device may be or otherwise may host control interface 200, discussed below.

In accordance with some embodiments, a control interface 200, which may be wired, wireless, or both, may be utilized in controlling solid-state light source(s) 120 of luminaire 100 and can have any of a wide range of configurations to that end. For example, in some embodiments, one or more switches (e.g., an array of switches) may be utilized to control the solid-state emitters 122 of a given solid-state light source 120 individually, in conjunction with one another, or both. As will be apparent in light of this disclosure, a given switch may be of any suitable type, such as, for example, a sliding switch, a rotary switch, a toggle switch, or a push-button switch, among others. In some instances, the switch-based control interface 200 may be operatively coupled with PLC module 148, driver(s) 140, controller(s) 180, or a combination thereof, which in turn interpret input from that control interface 200 and provide the desired control signal(s) to one or more of the solid-state emitters 122 of a given solid-state light source 120 operatively interfaced with a power socket 116 of luminaire 100.

In some embodiments, a device having a touch-sensitive display with a touch-based user interface (UI) or other touch-sensitive surface, such as a touchpad, may be utilized in controlling the solid-state emitter(s) 122 of a given solid-state light source 120 individually, in conjunction with one another, or both. In some instances, the touch-sensitive control interface 200 may be operatively coupled with PLC module 148, driver(s) 140, controller(s) 180, or a combination thereof, which in turn interpret input from that control interface 200 and provide the desired control signal(s) to one or more of the solid-state emitters 122 of a given solid-state light source 120 operatively interfaced with a power socket 116 of luminaire 100. In some other instances, the touch-sensitive control interface 200 may be operatively coupled directly with solid-state emitter(s) 122 to control them directly.

In some embodiments, a computer vision system that is, for example, gesture-sensitive, activity-sensitive, motion-sensitive, or a combination of any one or more thereof, may be utilized to control the solid-state emitter(s) 122 of a given solid-state light source 120, individually, in conjunction with one another, or both. In some such cases, this may provide for a luminaire 100 that can automatically adapt its light emissions based on a particular gesture-based command, sensed activity, or other stimulus. In some instances, the computer vision system control interface 200 may be operatively coupled with PLC module 148, driver(s) 140, controller(s) 180, or a combination thereof, which in turn interpret input from that control interface 200 and provide the desired control signal(s) to one or more of the solid-state emitters 122 of a given solid-state light source 120 operatively interfaced with a power socket 116 of luminaire 100. In some other instances, the computer vision system control interface 200 may be operatively coupled directly with solid-state emitter(s) 122 to control them directly. Other suitable configurations and capabilities for a given control interface 200, driver 140, and controller 180 will depend on a given application and will be apparent in light of this disclosure.

As previously discussed, the output of the one or more solid-state light sources 120 operatively interfaced with power sockets 116 of luminaire 100 may be dimmed, adjusted in color, or otherwise controlled, in accordance with some embodiments, to produce a given target light distribution for a given space or lighting application. Also, as previously discussed, the individual light beam spots of luminaire 100 can be controlled individually, in one or more groupings, or both, to provide a given target light distribution, in accordance with some embodiments. Thus, in accordance with some embodiments, solid-state light source(s) 120 of luminaire 100 may be controlled electronically, manually, or both, to produce an array of light beam spots having a given amount of overlap, which may be customized, as desired for a given target application or end-use. For example, in some embodiments, solid-state light source(s) 120 of luminaire 100 may be controlled to produce overlapping light beam spots (e.g., to provide for color tuning or mixing). In some other embodiments, solid-state light source(s) 120 of luminaire 100 may be controlled to produce a seamless, but not overlapping, array of light beam spots.

In some embodiments, luminaire 100 may be configured, for example, such that no two of its solid-state light sources 120 are pointed at the same spot on a given surface of incidence. Thus, there may be a one-to-one mapping of the solid-state light sources 120 of luminaire 100 to the light beam spots which it may produce on a given surface of incidence. This one-to-one mapping may provide for pixelated control over the light distribution of luminaire 100, in accordance with some embodiments. That is, luminaire 100 may be capable of outputting a polar, grid-like pattern of light beam spots which can be manipulated (e.g., in intensity, size, etc.), for instance, like the regular, rectangular grid of pixels of a display. Like the pixels of a display, the light beam spots produced by luminaire 100 can have minimal, maximal, or other targeted amount of overlap, as desired, in accordance with some embodiments. This may allow for the light distribution of luminaire 100 to be manipulated in a manner similar to the way that the pixels of a display can be manipulated to create different patterns, spot shapes, and distributions of light, in accordance with some embodiments. Furthermore, luminaire 100 may exhibit minimal or otherwise negligible overlap of the angular distributions of light of its solid-state light sources 120, and thus the light distribution of luminaire 100 can be adjusted (e.g., in intensity, size, etc.) as desired for a given target application or end-use. As will be appreciated in light of this disclosure, however, luminaire 100 also may be configured to provide for pointing two or more solid-state light sources 120 at the same spot (e.g., such as when color mixing is desired), in accordance with some embodiments. In a more general sense, and in accordance with some embodiments, the solid-state light sources 120 may be operatively interfaced with power sockets 116 mounted over a given interior surface 112 or exterior surface 114 of housing 110 such that their orientation provides any given target light beam distribution from luminaire 100.

Methodology

Figure 8A:
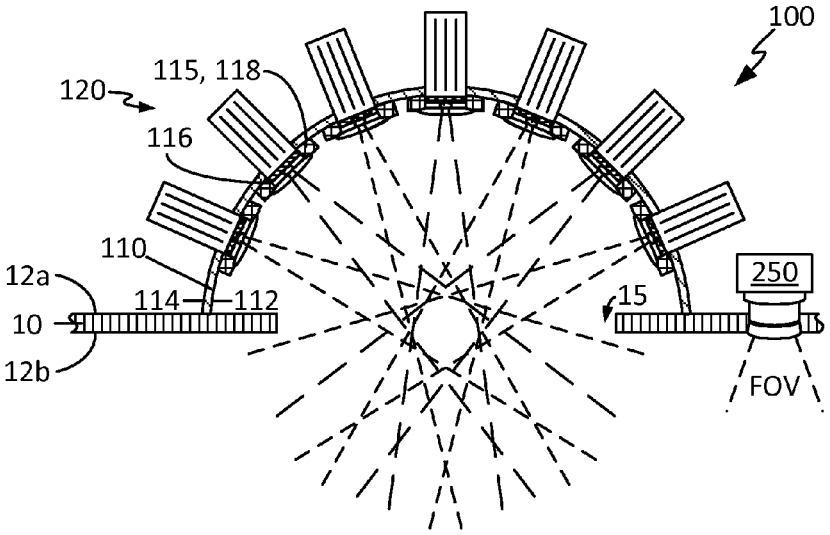
FIG. 8A is a cross-sectional view of a luminaire including a full arrangement of solid-state light sources and an associated image capture device, in accordance with an embodiment of the present disclosure.

In accordance with some embodiments, luminaire 100 can be utilized, for example, as a configuration tool in customizing the light distribution for a given space or target lighting application. More particularly, the process may begin with utilizing a luminaire 100 including a full arrangement of solid-state light sources 120 to produce a light beam distribution. FIG. 8A is a cross-sectional view of a luminaire 100 including a full arrangement of solid-state light sources 120 and an associated image capture device 250, in accordance with an embodiment of the present disclosure. All (or some sub-set) of the attendant solid-state light sources 120 may be powered on to produce a light beam distribution from luminaire 100.

Figure 8B:
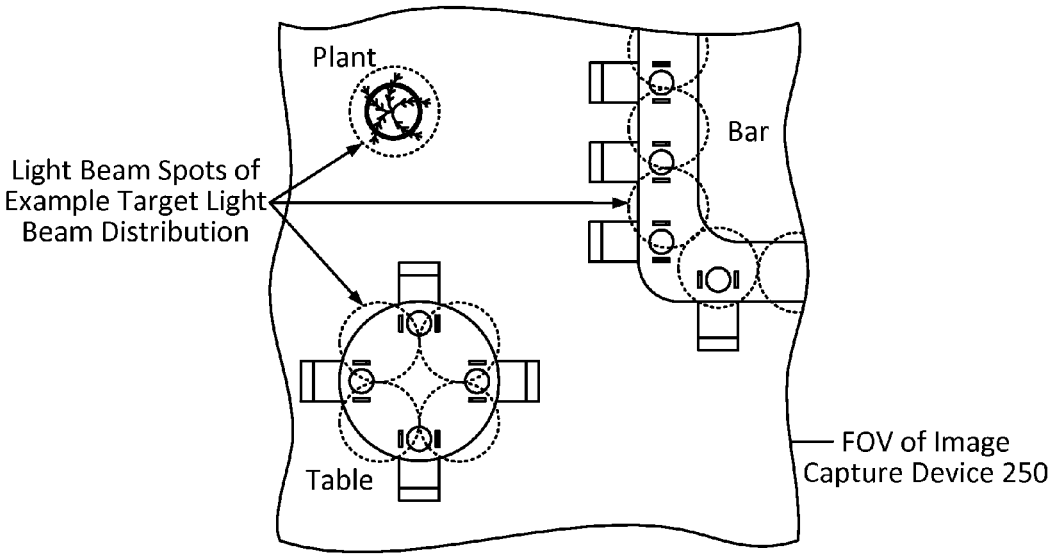
FIG. 8B illustrates a plan view of an example scene including an example target light beam distribution within the field of view (FOV) of the image capture device of FIG. 8A, in accordance with an embodiment of the present disclosure.

The process may continue with utilizing an image capture device 250 to capture an image inclusive of light beam spot(s) produced by luminaire 100 and incident on a given surface of incidence within its field of view (FOV). For example, consider FIG. 8B, which illustrates a plan view of an example scene including an example target light beam distribution within the FOV of the image capture device 250 of FIG. 8A, in accordance with an embodiment of the present disclosure. Image capture device 250 can be any device configured to capture digital images, such as a still camera (e.g., a camera configured to capture still photographs) or a video camera (e.g., a camera configured to capture moving images comprising a plurality of frames), and may be integrated, in part or in whole, with luminaire 100 or a separate device that is distinct from luminaire 100. In accordance with some embodiments, image capture device 250 can be configured to operate using light, for example, in the visible spectrum, the infrared (IR) spectrum, or the ultraviolet (UV) spectrum, among others. Componentry of image capture device 250 (e.g., optics assembly, image sensor, image/video encoder) may be implemented in hardware, software, firmware, or a combination thereof. In accordance with some embodiments, image capture device 250 may be configured, for example, to acquire image data in a periodic, continuous, or on-demand manner, or a combination thereof. The positioning and orientation of image capture device 250 with respect to mounting surface 10 and luminaire 100 may be customized, as desired. Other suitable configurations for image capture device 250 will depend on a given application and will be apparent in light of this disclosure.

Thereafter, the process may continue with processing, analyzing, or both, the captured image data to compare the observed light beam distribution with a target light beam distribution. To that end, image data captured by image capture device 250 may be communicated to luminaire 100, a computing device communicatively coupled with luminaire 100, or both. Processing and analysis may be performed, for example, via a processor 160, an application 152, or both, in accordance with some embodiments. If the observed light beam distribution does not substantially achieve (e.g., within a given tolerance) the target light distribution, then the process optionally may continue with adjusting the light output of one or more of the solid-state light sources 120 of luminaire 100 to reduce the differences observed. In accordance with some embodiments, such adjustment may be performed electronically, mechanically, or both, and may be done automatically, manually, or both, as desired. In some cases, control interface 200 may be utilized, in part or in whole, in such adjustment.

Figure 8C:
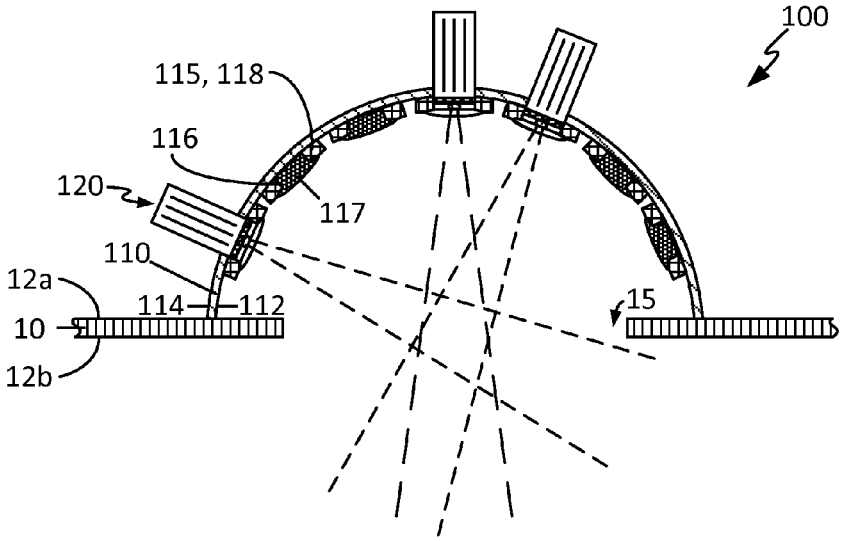
FIG. 8C is a cross-sectional view of a luminaire after removal of several excess solid-state light sources and an associated image capture device, in accordance with an embodiment of the present disclosure.

Once a target light beam distribution is sufficiently achieved, any solid-state light sources 120 not needed to maintain that distribution optionally may be removed from luminaire 100. In addition, image capture device 250 optionally may be removed, if desired. For example, consider FIG. 8C, which is a cross-sectional view of a luminaire 100 after removal of several excess solid-state light sources 120 and image capture device 250, in accordance with an embodiment of the present disclosure. As can be seen, the resultant luminaire 100 has fewer solid-state light sources 120 than its initial configuration in FIG. 8A, yet still provides the target light distribution. Any unutilized power sockets 116 of luminaire 100 may receive a filler plug 117, knockout piece, or other suitable cover element (e.g., for safety, aesthetics, etc.), in accordance with an embodiment.

As will be appreciated in light of this disclosure, by transitioning luminaire 100 between its initial setup as a configuration tool and its final setup for installation, the resultant luminaire 100 may retain the desired degree of flexibility in light beam distribution yet avoid incurring the cost of a full array of solid-state light sources 120, not all of which may be needed in a given space or lighting application. In effect, by separating the configuration task and the final installation of luminaire 100, a customized light beam pattern can be provided at lower commissioning and installation costs than otherwise would be associated with installation of a luminaire 100 with a full array of solid-state light sources 120.

Figure 9A:
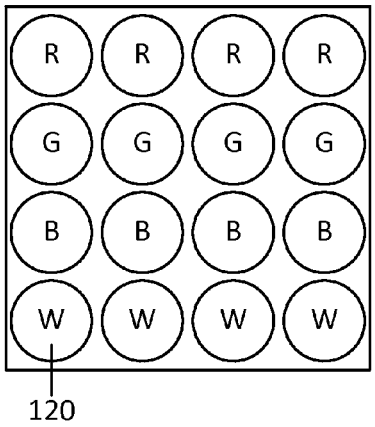
FIGS. 9A-9B illustrate several example assortments of solid-state light sources, in accordance with some embodiments of the present disclosure.
Figure 9B:
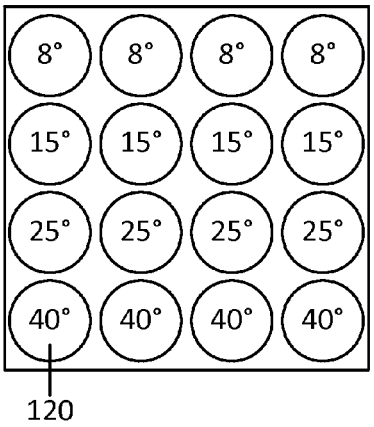

In an example scenario, a user may buy, rent, or otherwise obtain a luminaire 100 from a distributor, such as a do-it-yourself (DIY) store. The luminaire 100 may be provided, for instance, as an initially blank lighting fixture having no solid-state light sources 120 installed in its power sockets 116. In some cases, solid-state light sources 120 for use with that luminaire 100 may be provided along with the luminaire 100 for installation therein. In some other cases, solid-state light sources 120 for use with that luminaire 100 may be provided individually or in groupings or sets that are sold, rented, etc., separately from the luminaire 100. In some cases, an assortment of solid-state light sources 120 may be provided with or otherwise available for use with luminaire 100. For instance, consider FIGS. 9A-9B, which illustrate several example assortments of solid-state light sources 120, in accordance with some embodiments of the present disclosure. A given assortment of solid-state light sources 120 may be, for example, of different emissions colors (e.g., red, green, blue, white, etc., as in FIG. 9A), different beam angles (e.g., 8°, 15°, 25°, 40°, etc., as in FIG. 9B), different power levels, different dimming capabilities, or a combination thereof, among others. It should be noted, however, that the present disclosure is not intended to be limited only to the specific examples depicted in FIGS. 9A-9B, as the quantities, types, and arrangements of solid-state light sources 120 of a given assortment may be customized, as desired for a given target application or end-use. Numerous different assortments of solid-state light sources 120 may be provided as described herein. In some instances, a control interface 200, such as a mobile or other computing device, also may be provided to the user to facilitate control and configuration of luminaire 100. Control interface 200 may be utilized, in accordance with some embodiments, to provide one or more command signals to luminaire 100, a given solid-state light source 120, or both.

Numerous embodiments will be apparent in light of this disclosure. One example embodiment provides a solid-state luminaire including: a housing; a plurality of power sockets arranged over the housing; a processor configured to process at least one of position data and orientation data pertaining to a given power socket; and a controller configured to utilize at least one of the position and location data pertaining to that power socket in electronically controlling light emitted by a solid-state light source operatively interfaced therewith, wherein the controller provides for pixelated control over light distribution of the solid-state luminaire, allowing for partial population of the plurality of power sockets with one or more solid-state light sources while providing a target light beam distribution. In some cases, the solid-state luminaire further includes a driver electrically coupled with at least one power socket and configured to further electronically control output of a solid-state light source operatively interfaced with the at least one power socket. In some such cases, the solid-state luminaire further includes a power-line communication (PLC) module configured to output a PLC signal utilized by the driver in electronically controlling output of the solid-state light source operatively interfaced with the at least one power socket. In some other such cases, at least a portion of the plurality of power sockets is electrically connected in series, and the driver electrically coupled therewith is a constant current driver. In some instances, the solid-state luminaire further includes a communication module configured to utilize at least one of a digital multiplexer (DMX) interface protocol, a Wi-Fi protocol, a Bluetooth protocol, a digital addressable lighting interface (DALI) protocol, and a ZigBee protocol in further electronically controlling output of a solid-state light source operatively interfaced with at least one power socket. In some instances, the solid-state luminaire further includes the solid-state light source operatively interfaced with at least one power socket. In some such instances, the solid-state light source includes a driver configured to further electronically control output of the solid-state light source, and the luminaire further includes a power-line communication (PLC) module configured to output a PLC signal to the driver through the at least one power socket, wherein the PLC signal is utilized by the driver in electronically controlling output of the solid-state light source. In some other such instances, the solid-state light source further includes: a driver configured to further electronically control output of the solid-state light source; and at least one of a battery and a supercapacitor electrically coupled with the driver. In some still other such instances, the solid-state luminaire further includes memory communicatively coupled with the processor, and the solid-state light source further includes a communication module configured to communicate operative interfacing of the solid-state light source with the at least one power socket to at least one of the memory and the processor. In some yet other such instances, the solid-state light source is associated with a first radio-frequency identification (RFID) address, the at least one power socket with which the solid-state light source is operatively interfaced is associated with a second RFID address, and the solid-state light source further includes a communication module configured to communicate at least one of the first and second RFID addresses to the processor. In some still other such instances, the solid-state light source further includes a beam angle adjuster configured to at least one of electronically and mechanically adjust a beam angle of output of the solid-state light source. In some yet other such instances, the solid-state light source includes: a laser diode; and a laser-activated remote phosphor (LARP) configured to emit light of a different wavelength than light received from the laser diode. In some cases, at least one of the power sockets is compliant with ANSI/SAE Standard J563 (Standard for 12 Volt Cigarette Lighters, Power Outlets, and Accessory Plugs). In some cases, at least one of the power sockets is compliant with a Zhaga Consortium standard.

Another example embodiment provides a solid-state luminaire including: a housing that is at least one of hemispherical, sub-hemispherical, hyper-hemispherical, and oblate hemispherical in shape; a plurality of power sockets electrically connected with one another via a foldable printed circuit board (PCB) disposed over a curved surface of the housing; a processor configured to process at least one of position data and orientation data pertaining to a given power socket; and a controller configured to utilize at least one of the position and location data pertaining to that power socket in electronically controlling light emitted by a solid-state light source operatively interfaced therewith, wherein the controller provides for pixelated control over light distribution of the solid-state luminaire, allowing for partial population of the plurality of power sockets with one or more solid-state light sources while providing a target light beam distribution. In some cases, the solid-state luminaire further includes a driver electrically coupled with at least one power socket and configured to further electronically control output of a solid-state light source operatively interfaced with the at least one power socket. In some such cases, the solid-state luminaire further includes a power-line communication (PLC) module configured to output a PLC signal utilized by the driver in electronically controlling output of the solid-state light source operatively interfaced with the at least one power socket.

Another example embodiment provides a solid-state luminaire including: a housing configured as a recessed lighting can; a plurality of power sockets disposed over a frame within the housing; a processor configured to process at least one of position data and orientation data pertaining to a given power socket; and a controller configured to utilize at least one of the position and location data pertaining to that power socket in electronically controlling light emitted by a solid-state light source operatively interfaced therewith, wherein the controller provides for pixelated control over light distribution of the solid-state luminaire, allowing for partial population of the plurality of power sockets with one or more solid-state light sources while providing a target light beam distribution. In some instances, the solid-state luminaire further includes a driver electrically coupled with at least one power socket and configured to further electronically control output of a solid-state light source operatively interfaced with the at least one power socket. In some such instances, the solid-state luminaire further includes a power-line communication (PLC) module configured to output a PLC signal utilized by the driver in electronically controlling output of the solid-state light source operatively interfaced with the at least one power socket.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A solid-state luminaire comprising:

a housing;

a plurality of power sockets arranged over the housing;

a processor configured to process at least one of position data and orientation data pertaining to a given power socket; and a controller configured to utilize at least one of the position and location data pertaining to that power socket in electronically controlling light emitted by a solid-state light source operatively interfaced therewith, wherein the controller provides for pixelated control over light distribution of the solid-state luminaire, allowing for partial population of the plurality of power sockets with one or more solid-state light sources while providing a target light beam distribution.

2. The solid-state luminaire of claim 1 further comprising a driver electrically coupled with at least one power socket and configured to further electronically control output of a solid-state light source operatively interfaced with the at least one power socket.

3. The solid-state luminaire of claim 2, wherein the solid-state luminaire further comprises a power-line communication (PLC) module configured to output a PLC signal utilized by the driver in electronically controlling output of the solid-state light source operatively interfaced with the at least one power socket.

4. The solid-state luminaire of claim 2, wherein:

at least a portion of the plurality of power sockets is electrically connected in series; and the driver electrically coupled therewith is a constant current driver.

5. The solid-state luminaire of claim 1 further comprising a communication module configured to utilize at least one of a digital multiplexer (DMX) interface protocol, a Wi-Fi protocol, a Bluetooth protocol, a digital addressable lighting interface (DALI) protocol, and a ZigBee protocol in further electronically controlling output of a solid-state light source operatively interfaced with at least one power socket.

6. The solid-state luminaire of claim 1 further comprising the solid-state light source operatively interfaced with at least one power socket.

7. The solid-state luminaire of claim 6, wherein:

the solid-state light source comprises a driver configured to further electronically control output of the solid-state light source; and the luminaire further comprises a power-line communication (PLC) module configured to output a PLC signal to the driver through the at least one power socket, wherein the PLC signal is utilized by the driver in electronically controlling output of the solid-state light source.

8. The solid-state luminaire of claim 6, wherein the solid-state light source further comprises:

a driver configured to further electronically control output of the solid-state light source; and at least one of a battery and a supercapacitor electrically coupled with the driver.

9. The solid-state luminaire of claim 6, wherein:

the solid-state luminaire further comprises memory communicatively coupled with the processor; and the solid-state light source further comprises a communication module configured to communicate operative interfacing of the solid-state light source with the at least one power socket to at least one of the memory and the processor.

10. The solid-state luminaire of claim 6, wherein:

the solid-state light source is associated with a first radio-frequency identification (RFID) address;

the at least one power socket with which the solid-state light source is operatively interfaced is associated with a second RFID address; and the solid-state light source further comprises a communication module configured to communicate at least one of the first and second RFID addresses to the processor.

11. The solid-state luminaire of claim 6, wherein the solid-state light source further comprises a beam angle adjuster configured to at least one of electronically and mechanically adjust a beam angle of output of the solid-state light source.

12. The solid-state luminaire of claim 6, wherein the solid-state light source comprises:

a laser diode; and a laser-activated remote phosphor (LARP) configured to emit light of a different wavelength than light received from the laser diode.

13. The solid-state luminaire of claim 1, wherein at least one of the power sockets is compliant with ANSI/SAE Standard J563 (Standard for 12 Volt Cigarette Lighters, Power Outlets, and Accessory Plugs).

14. The solid-state luminaire of claim 1, wherein at least one of the power sockets is compliant with a Zhaga Consortium standard.

15. A solid-state luminaire comprising:

a housing that is at least one of hemispherical, sub-hemispherical, hyper-hemispherical, and oblate hemispherical in shape;

a plurality of power sockets electrically connected with one another via a foldable printed circuit board (PCB) disposed over a curved surface of the housing;

a processor configured to process at least one of position data and orientation data pertaining to a given power socket; and a controller configured to utilize at least one of the position and location data pertaining to that power socket in electronically controlling light emitted by a solid-state light source operatively interfaced therewith, wherein the controller provides for pixelated control over light distribution of the solid-state luminaire, allowing for partial population of the plurality of power sockets with one or more solid-state light sources while providing a target light beam distribution.

16. The solid-state luminaire of claim 15 further comprising a driver electrically coupled with at least one power socket and configured to further electronically control output of a solid-state light source operatively interfaced with the at least one power socket.

17. The solid-state luminaire of claim 16 further comprising a power-line communication (PLC) module configured to output a PLC signal utilized by the driver in electronically controlling output of the solid-state light source operatively interfaced with the at least one power socket.

18. A solid-state luminaire comprising:

a housing configured as a recessed lighting can;

a plurality of power sockets disposed over a frame within the housing;

a processor configured to process at least one of position data and orientation data pertaining to a given power socket; and a controller configured to utilize at least one of the position and location data pertaining to that power socket in electronically controlling light emitted by a solid-state light source operatively interfaced therewith, wherein the controller provides for pixelated control over light distribution of the solid-state luminaire, allowing for partial population of the plurality of power sockets with one or more solid-state light sources while providing a target light beam distribution.

19. The solid-state luminaire of claim 18 further comprising a driver electrically coupled with at least one power socket and configured to further electronically control output of a solid-state light source operatively interfaced with the at least one power socket.

20. The solid-state luminaire of claim 19 further comprising a power-line communication (PLC) module configured to output a PLC signal utilized by the driver in electronically controlling output of the solid-state light source operatively interfaced with the at least one power socket.

* * * * *